US012180861B1

(12) United States Patent
Bodishbaugh et al.

(10) Patent No.: US 12,180,861 B1
(45) Date of Patent: Dec. 31, 2024

(54) SYSTEMS AND METHODS TO UTILIZE HEAT CARRIERS IN CONVERSION OF THERMAL ENERGY

(71) Applicant: ICE Thermal Harvesting, LLC, Houston, TX (US)

(72) Inventors: Adrian Benjamin Bodishbaugh, Houston, TX (US); Carrie Jeanne Murtland, Houston, TX (US)

(73) Assignee: ICE Thermal Harvesting, LLC, Houston, TX (US)

( * ) Notice: Subject to any disclaimer, the term of this patent is extended or adjusted under 35 U.S.C. 154(b) by 0 days.

(21) Appl. No.: 18/397,037

(22) Filed: Dec. 27, 2023

Related U.S. Application Data

(60) Provisional application No. 63/478,012, filed on Dec. 30, 2022.

(51) Int. Cl.
*F01K 23/10* (2006.01)
*E21B 41/00* (2006.01)
(Continued)

(52) U.S. Cl.
CPC ..... *F01K 23/10* (2013.01); *E21B 41/0085* (2013.01); *F01K 25/06* (2013.01); *F01K 25/08* (2013.01)

(58) Field of Classification Search
CPC ..... F01K 23/10; F01K 25/06; F01K 25/08; E21B 41/0085
(Continued)

(56) References Cited

U.S. PATENT DOCUMENTS 1,982,745 A * 12/1934 Koenemann ..... B01J 3/08 60/649
3,517,208 A 6/1970 Williams et al.
(Continued)

FOREIGN PATENT DOCUMENTS

AU 2007204830 A1 7/2007
AU 2009238733 B2 8/2013
(Continued)

OTHER PUBLICATIONS

International Search Report and Written Opinion for PCT/US2022/071480, Aug. 3, 2022.
(Continued)

*Primary Examiner* — Hoang M Nguyen
(74) *Attorney, Agent, or Firm* — Womble Bond Dickinson (US) LLP

(57) ABSTRACT

Embodiments of systems and methods for converting thermal energy to electrical power are disclosed. In embodiments, a system for converting thermal energy to electrical power may include a thermal cycle device. The thermal cycle device may include an evaporator including a first fluid path for a flow of heated fluid and a second fluid path for a flow of a working fluid and configured to indirectly transfer heat from the flow of heated fluid to the flow of working fluid, a condenser to cool the working fluid, a pump to transport working fluid from the condenser, an expander to generate electrical power via the working fluid, and a loop for the flow of the working fluid. The system may include an amount of heat carrier injected into the loop and configured to adsorb and desorb the working fluid and generate additional heat to increase output of electrical power.

28 Claims, 13 Drawing Sheets

(51) Int. Cl.
*F01K 25/06* (2006.01)
*F01K 25/08* (2006.01)

(58) Field of Classification Search
USPC ..... 60/649
See application file for complete search history.

(56) References Cited

U.S. PATENT DOCUMENTS 3,757,516 A 9/1973 McCabe
3,808,794 A 5/1974 Wood
3,875,749 A 4/1975 Baciu
3,908,381 A 9/1975 Barber et al.
3,988,895 A 11/1976 Sheinbaum
4,063,417 A 12/1977 Shields
4,079,590 A 3/1978 Sheinbaum
4,112,687 A 9/1978 Dixon
4,112,745 A 9/1978 McCabe
4,149,385 A 4/1979 Sheinbaum
4,157,730 A 6/1979 Despois et al.
4,191,021 A * 3/1980 Nakamura ..... F01K 25/08 60/671
4,224,796 A 9/1980 Stiel et al.
4,228,657 A 10/1980 Leo
4,275,563 A * 6/1981 Kuroda ..... F01K 25/08 165/111
4,292,808 A * 10/1981 Lohmiller ..... F01K 21/06 60/649
4,356,401 A 10/1982 Santi
4,369,373 A 1/1983 Wiseman
4,484,446 A 11/1984 Goldsberry
4,542,625 A 9/1985 Bronicki
4,558,568 A 12/1985 Hoshino et al.
4,576,005 A 3/1986 Force
4,590,384 A 5/1986 Bronicki
4,982,568 A 1/1991 Kalina
4,996,846 A 3/1991 Bronicki
5,038,567 A 8/1991 Mortiz
5,117,908 A 6/1992 Hofmann
5,131,231 A * 7/1992 Trimble ..... F02C 1/10 60/668
5,199,507 A 4/1993 Westmoreland
5,311,741 A 5/1994 Blaize
5,421,157 A 6/1995 Rosenblatt
5,440,882 A 8/1995 Kalina
5,483,797 A 1/1996 Rigal et al.
5,497,624 A 3/1996 Amir et al.
5,517,822 A 5/1996 Haws et al.
5,526,646 A 6/1996 Bronicki et al.
5,555,731 A 9/1996 Rosenblatt
5,570,579 A 11/1996 Larjola
5,595,059 A 1/1997 Huber et al.
5,598,706 A 2/1997 Bronicki et al.
5,660,042 A 8/1997 Bronicki et al.
5,661,977 A 9/1997 Shnell
5,671,601 A 9/1997 Bronicki et al.
5,685,362 A 11/1997 Brown
5,816,048 A 10/1998 Bronicki et al.
5,839,282 A 11/1998 Bronicki et al.
5,860,279 A 1/1999 Bronicki et al.
RE36,282 E 8/1999 Nitschke
5,970,714 A 10/1999 Bronicki et al.
5,974,804 A 11/1999 Sterling
6,073,448 A 6/2000 Lozada
6,212,890 B1 4/2001 Amir
6,536,360 B2 3/2003 O'Connor
6,585,047 B2 7/2003 McClung
6,691,531 B1 2/2004 Martinez
6,695,061 B2 2/2004 Fripp et al.
6,724,687 B1 4/2004 Stephenson et al.
6,853,798 B1 2/2005 Weiss
6,857,268 B2 2/2005 Stinger et al.
6,857,486 B2 2/2005 Chitwood et al.
6,989,989 B2 1/2006 Brasz et al.
7,096,665 B2 8/2006 Stinger et al.
7,174,716 B2 2/2007 Brasz et al.
7,224,080 B2 5/2007 Smedstad
7,225,621 B2 6/2007 Zimron et al.
7,234,314 B1 6/2007 Wiggs
7,237,383 B2 7/2007 Ahrens-Botzong et al.
7,254,949 B2 8/2007 Brasz et al.
7,281,379 B2 10/2007 Brasz
7,287,381 B1 10/2007 Pierson et al.
7,289,325 B2 10/2007 Brasz et al.
7,313,926 B2 1/2008 Gurin
7,320,221 B2 1/2008 Bronicki
7,334,410 B2 2/2008 Creighton et al.
7,337,842 B2 3/2008 Roddy et al.
7,353,653 B2 4/2008 Bronicki
7,428,816 B2 9/2008 Singh et al.
7,472,548 B2 1/2009 Meksvanh
7,493,768 B2 2/2009 Klaus et al.
7,753,122 B2 7/2010 Curlett
7,823,386 B2 11/2010 Zimron et al.
7,891,187 B2 2/2011 Mohr
7,891,189 B2 2/2011 Bottger et al.
7,900,450 B2 3/2011 Gurin
7,926,276 B1 * 4/2011 Dunn ..... F01K 15/04 60/682
7,934,383 B2 5/2011 Gutierrez et al.
7,942,001 B2 5/2011 Radcliff et al.
7,950,230 B2 5/2011 Nishikawa et al.
7,987,676 B2 8/2011 Ast et al.
8,046,999 B2 11/2011 Doty
8,096,128 B2 1/2012 Held et al.
8,099,198 B2 1/2012 Gurin
8,146,360 B2 4/2012 Myers et al.
8,166,761 B2 5/2012 Moghtaderi et al.
8,193,659 B2 6/2012 Bronicki et al.
8,272,217 B2 9/2012 Lengert
8,309,498 B2 11/2012 Funkhouser et al.
8,371,099 B2 2/2013 Gutierrez et al.
8,381,523 B2 2/2013 Zadok
8,430,166 B2 4/2013 Danko
8,438,849 B2 5/2013 Kaplan et al.
8,459,029 B2 6/2013 Lehar
8,511,085 B2 8/2013 Frey et al.
8,528,333 B2 9/2013 Juchymenko
8,534,069 B2 9/2013 Parrella
8,555,643 B2 10/2013 Kalina
8,555,912 B2 10/2013 Woolley et al.
8,572,970 B2 11/2013 Matteson et al.
8,578,714 B2 11/2013 Nagurny et al.
8,596,066 B2 12/2013 Zimron et al.
8,616,000 B2 12/2013 Parrella
8,616,001 B2 12/2013 Held et al.
8,616,323 B1 12/2013 Gurin
8,656,720 B1 2/2014 Hardgrave
8,667,797 B2 * 3/2014 Woodland ..... F01K 25/06 60/671
8,667,799 B2 3/2014 Batscha
8,674,525 B2 3/2014 Van den Bossche et al.
8,680,704 B1 3/2014 Rooney
8,707,697 B2 4/2014 Nitschke
8,707,698 B2 4/2014 Conry
8,708,046 B2 4/2014 Montgomery et al.
8,720,563 B2 5/2014 Joseph et al.
8,752,382 B2 6/2014 Lehar
8,756,908 B2 6/2014 Sheridan et al.
8,771,603 B2 7/2014 Harless et al.
8,783,034 B2 7/2014 Held
8,791,054 B2 7/2014 Deville
8,820,075 B2 9/2014 Kaminsky
8,820,079 B2 9/2014 Zyhowski et al.
8,839,857 B2 9/2014 Schultz et al.
8,841,041 B2 9/2014 Biederman et al.
8,850,814 B2 10/2014 Kaplan et al.
8,857,186 B2 10/2014 Held
8,869,531 B2 10/2014 Held
8,881,805 B2 11/2014 Klemencic
8,919,123 B2 12/2014 Gibble et al.
8,959,914 B2 2/2015 Kasuya et al.
8,984,883 B2 3/2015 Riley
8,984,884 B2 3/2015 Xu et al.

(56) References Cited

U.S. PATENT DOCUMENTS

| | | | |
|---|---|---|---|
| 9,003,798 | B2 | 4/2015 | Yanagi |
| 9,014,791 | B2 | 4/2015 | Held |
| 9,016,063 | B2 | 4/2015 | Gaia et al. |
| 9,062,898 | B2 | 6/2015 | Held et al. |
| 9,077,220 | B2 | 7/2015 | Kyle et al. |
| 9,080,789 | B2 | 7/2015 | Hamstra et al. |
| 9,091,278 | B2 | 7/2015 | Vermeersch |
| 9,109,398 | B2 | 8/2015 | Harris et al. |
| 9,115,603 | B2 | 8/2015 | Leibowitz et al. |
| 9,115,604 | B2 | 8/2015 | Bronicki |
| 9,118,226 | B2 | 8/2015 | Kacludis et al. |
| 9,121,259 | B2 | 9/2015 | Bryant et al. |
| 9,150,774 | B2 | 10/2015 | Reddy et al. |
| 9,181,930 | B2 | 11/2015 | Klemencic |
| 9,217,370 | B2 | 12/2015 | Wang et al. |
| 9,234,522 | B2 | 1/2016 | Jonsson et al. |
| 9,243,616 | B2 | 1/2016 | Lee et al. |
| 9,297,367 | B2 | 3/2016 | Ramaswamy et al. |
| 9,316,404 | B2 | 4/2016 | Gurin |
| 9,322,300 | B2 | 4/2016 | Mirmobin et al. |
| 9,331,547 | B2 | 5/2016 | Bronicki |
| 9,341,084 | B2 | 5/2016 | Xie et al. |
| 9,341,086 | B2 | 5/2016 | Batscha et al. |
| 9,359,919 | B1 | 6/2016 | Berry |
| 9,376,937 | B2 | 6/2016 | Goswami et al. |
| 9,394,764 | B2 | 7/2016 | Favilli et al. |
| 9,394,771 | B2 | 7/2016 | Wiggs |
| 9,403,102 | B2 | 8/2016 | Wu et al. |
| 9,441,504 | B2 | 9/2016 | Held |
| 9,458,738 | B2 | 10/2016 | Held et al. |
| 9,488,160 | B2 | 11/2016 | Fisher et al. |
| 9,499,732 | B2 | 11/2016 | Reddy et al. |
| 9,512,348 | B2 | 12/2016 | Reyes et al. |
| 9,512,741 | B2 | 12/2016 | Myogan et al. |
| 9,574,551 | B2 | 2/2017 | Parrella, Sr. et al. |
| 9,587,161 | B2 | 3/2017 | Fisk, Jr. |
| 9,587,162 | B2 | 3/2017 | Fisk, Jr. |
| 9,638,065 | B2 | 5/2017 | Vermeersch et al. |
| 9,649,582 | B2 | 5/2017 | Shnell |
| 9,671,138 | B2 | 6/2017 | Batscha et al. |
| 9,683,463 | B2 | 6/2017 | Juchymenko |
| 9,726,157 | B2 | 8/2017 | Sweatman et al. |
| 9,726,441 | B2 | 8/2017 | Reissner et al. |
| 9,732,634 | B2 | 8/2017 | Hikichi et al. |
| 9,745,870 | B2 | 8/2017 | Johnson et al. |
| 9,759,096 | B2 | 9/2017 | Vermeersch |
| 9,762,460 | B2 | 9/2017 | Pawlowski et al. |
| 9,777,602 | B2 | 10/2017 | Juchymenko |
| 9,784,140 | B2 | 10/2017 | Huntington et al. |
| 9,784,248 | B2 | 10/2017 | Batscha et al. |
| 9,797,273 | B2 | 10/2017 | Nishiguchi et al. |
| 9,803,803 | B1 | 10/2017 | Adams |
| 9,816,402 | B2 | 11/2017 | Kauffman et al. |
| 9,816,443 | B2 | 11/2017 | Sheridan et al. |
| 9,829,194 | B2 | 11/2017 | Aumann et al. |
| 9,840,662 | B2 | 12/2017 | Pascarella et al. |
| 9,845,423 | B2 | 12/2017 | Frantz et al. |
| 9,863,282 | B2 | 1/2018 | Hart et al. |
| 9,874,112 | B2 | 1/2018 | Giegel |
| 9,932,861 | B2 | 4/2018 | Preuss et al. |
| 9,932,970 | B1 | 4/2018 | Jeter |
| 9,957,432 | B2 | 5/2018 | Galindo et al. |
| 9,994,751 | B2 | 6/2018 | Hulse et al. |
| 10,005,950 | B2 | 6/2018 | Smith et al. |
| 10,024,198 | B2 | 7/2018 | Held et al. |
| 10,059,870 | B2 | 8/2018 | Joseph et al. |
| 10,060,283 | B2 | 8/2018 | Tomigashi et al. |
| 10,060,302 | B2 | 8/2018 | Weng et al. |
| 10,060,652 | B2 | 8/2018 | Tahara |
| 10,077,683 | B2 | 9/2018 | Close |
| 10,082,030 | B2 | 9/2018 | Genrup et al. |
| 10,113,389 | B2 | 10/2018 | Pandey et al. |
| 10,113,535 | B2 | 10/2018 | Conlon |
| 10,138,405 | B2 | 11/2018 | Kulkarni et al. |
| 10,138,560 | B2 | 11/2018 | Reyes et al. |
| 10,221,770 | B2 | 3/2019 | Sheridan |
| 10,227,893 | B2 | 3/2019 | McCune et al. |
| 10,234,183 | B2 | 3/2019 | Hashimoto |
| 10,247,044 | B2 | 4/2019 | Barmeier et al. |
| 10,247,046 | B2 | 4/2019 | Schuster et al. |
| 10,267,184 | B2 | 4/2019 | Bowan et al. |
| 10,323,545 | B2 | 6/2019 | Johnson |
| 10,352,197 | B2 | 7/2019 | Grill et al. |
| 10,357,726 | B2 | 7/2019 | Qin et al. |
| 10,400,635 | B2 | 9/2019 | Johnson et al. |
| 10,435,604 | B2 | 10/2019 | Kontomaris et al. |
| 10,436,075 | B2 | 10/2019 | Freund et al. |
| 10,458,206 | B2 | 10/2019 | Al-Dossary et al. |
| 10,465,104 | B2 | 11/2019 | Ravi et al. |
| 10,465,491 | B2 | 11/2019 | Moore |
| 10,472,994 | B2 | 11/2019 | Avadhanula et al. |
| 10,494,897 | B2 | 12/2019 | Pandey et al. |
| 10,495,098 | B2 | 12/2019 | Preuss et al. |
| 10,519,814 | B2 | 12/2019 | Quoilin |
| 10,527,026 | B2 | 1/2020 | Muir et al. |
| 10,563,927 | B2 | 2/2020 | Papadopoulos et al. |
| 10,570,777 | B2 | 2/2020 | Bowan |
| 10,570,782 | B2 | 2/2020 | Lintl et al. |
| 10,584,660 | B2 | 3/2020 | Sheridan et al. |
| 10,590,324 | B2 | 3/2020 | Kulkarni et al. |
| 10,590,802 | B2 | 3/2020 | McCune et al. |
| 10,598,160 | B2 | 3/2020 | Sumrall |
| 10,619,520 | B2 | 4/2020 | Juchymenko |
| 10,626,709 | B2 | 4/2020 | Al-Dossary |
| 10,670,340 | B2 | 6/2020 | Batscha et al. |
| 10,724,805 | B2 | 7/2020 | Barmeier et al. |
| 10,767,904 | B2 | 9/2020 | von Düring |
| 10,788,267 | B2 | 9/2020 | Dokic et al. |
| 10,794,292 | B2 | 10/2020 | Kupratis et al. |
| 10,883,388 | B2 | 1/2021 | Held |
| 10,934,895 | B2 | 3/2021 | Held et al. |
| 10,947,626 | B2 | 3/2021 | Pinder et al. |
| 10,947,839 | B2 | 3/2021 | Cuthbert et al. |
| 10,975,279 | B2 | 4/2021 | Kontomaris et al. |
| 11,022,070 | B2 | 6/2021 | Aumann et al. |
| 11,137,169 | B2 | 10/2021 | Buscheck et al. |
| 11,168,673 | B2 | 11/2021 | Younes et al. |
| 11,174,715 | B2 | 11/2021 | Atisele |
| 11,187,112 | B2 | 11/2021 | Held |
| 11,187,212 | B1 | 11/2021 | Bodishbaugh et al. |
| 11,220,932 | B2 | 1/2022 | Kontomaris et al. |
| 11,236,735 | B1 | 2/2022 | Bodishbaugh et al. |
| 11,255,315 | B1 | 2/2022 | Bodishbaugh et al. |
| 11,255,576 | B2 | 2/2022 | Higgins et al. |
| 11,274,660 | B2 | 3/2022 | Radke |
| 11,274,663 | B1 | 3/2022 | Bodishbaugh et al. |
| 11,280,322 | B1 | 3/2022 | Bodishbaugh et al. |
| 11,293,414 | B1 | 4/2022 | Bodishbaugh et al. |
| 11,326,479 | B2 | 5/2022 | Radke |
| 11,326,550 | B1 | 5/2022 | Bodishbaugh et al. |
| 11,359,576 | B1 | 6/2022 | Bodishbaugh et al. |
| 11,359,612 | B1 | 6/2022 | Bodishbaugh et al. |
| 11,365,652 | B2 | 6/2022 | Gaia et al. |
| 11,396,828 | B2 | 7/2022 | Chase |
| 11,421,625 | B1 | 8/2022 | Bodishbaugh et al. |
| 11,421,663 | B1 | 8/2022 | Bodishbaugh et al. |
| 11,480,074 | B1 | 10/2022 | Bodishbaugh et al. |
| 11,486,330 | B2 | 11/2022 | Bodishbaugh et al. |
| 11,486,370 | B2 | 11/2022 | Bodishbaugh et al. |
| 11,493,029 | B2 | 11/2022 | Bodishbaugh et al. |
| 11,542,888 | B2 | 1/2023 | Bodishbaugh et al. |
| 11,549,402 | B2 | 1/2023 | Bodishbaugh et al. |
| 11,572,849 | B1 | 2/2023 | Bodishbaugh et al. |
| 11,578,706 | B2 | 2/2023 | Bodishbaugh et al. |
| 11,592,009 | B2 | 2/2023 | Bodishbaugh et al. |
| 11,598,320 | B2 | 3/2023 | Bodishbaugh et al. |
| 11,624,355 | B2 | 4/2023 | Bodishbaugh et al. |
| 11,644,014 | B2 | 5/2023 | Bodishbaugh et al. |
| 11,644,015 | B2 | 5/2023 | Bodishbaugh et al. |
| 11,668,209 | B2 | 6/2023 | Bodishbaugh et al. |
| 11,680,541 | B2 | 6/2023 | Bodishbaugh et al. |
| 11,732,697 | B2 | 8/2023 | Bodishbaugh et al. |
| 11,761,353 | B2 | 9/2023 | Bodishbaugh et al. |
| 11,761,433 | B2 | 9/2023 | Bodishbaugh et al. |

(56) References Cited

U.S. PATENT DOCUMENTS 11,773,805 B2 10/2023 Bodishbaugh et al.
11,879,409 B2 1/2024 Bodishbaugh et al.
11,905,934 B2 2/2024 Bodishbaugh et al.
11,933,279 B2 3/2024 Bodishbaugh
11,933,280 B2 3/2024 Bodishbaugh
11,946,459 B2 4/2024 Bodishbaugh
11,959,466 B2 4/2024 Bodishbaugh
11,971,019 B2 4/2024 Bodishbaugh
12,049,875 B2 7/2024 Bodishbaugh
12,060,867 B2 8/2024 Bodishbaugh
12,104,553 B2 10/2024 Bodishbaugh
12,110,878 B2 10/2024 Bodishbaugh
2002/0178723 A1 12/2002 Bronicki et al.
2003/0010652 A1 1/2003 Hunt
2003/0029169 A1 2/2003 Hanna et al.
2004/0237890 A1 12/2004 Bour
2005/0034467 A1 2/2005 Varney
2005/0109495 A1 5/2005 Cheng et al.
2005/0247056 A1 11/2005 Cogswell et al.
2005/0247059 A1 11/2005 Cogswell et al.
2006/0026961 A1 2/2006 Bronicki
2006/0130480 A1 6/2006 Lovelace
2007/0025854 A1 2/2007 Moore et al.
2008/0095611 A1 4/2008 Storage
2008/0168772 A1 7/2008 Radcliff et al.
2008/0217523 A1 9/2008 O'Sullivan
2009/0071155 A1* 3/2009 Boyapati ..... F02G 5/02 60/649
2009/0211253 A1 8/2009 Radcliff et al.
2009/0217664 A1 9/2009 Rapp et al.
2009/0313999 A1 12/2009 Hunter
2009/0320477 A1 12/2009 Juchymenko
2010/0018207 A1 1/2010 Juchymenko
2010/0034684 A1* 2/2010 Ast ..... F01K 25/06 418/98
2010/0045042 A1 2/2010 Hinders et al.
2010/0071366 A1 3/2010 Klemencic
2010/0071409 A1 3/2010 Kaart
2010/0077752 A1 4/2010 Papile
2010/0077792 A1 4/2010 Gurin
2010/0187319 A1 7/2010 Isom et al.
2010/0192573 A1 8/2010 Hamilton
2010/0194111 A1 8/2010 Van den Bossche et al.
2010/0218930 A1 9/2010 Proeschel
2010/0300093 A1 12/2010 Doty
2010/0319354 A1 12/2010 Guidati et al.
2011/0000210 A1 1/2011 Miles
2011/0000227 A1 1/2011 Kamiya
2011/0030404 A1 2/2011 Gurin et al.
2011/0041502 A1 2/2011 Zimron et al.
2011/0041505 A1 2/2011 Kasuya et al.
2011/0083620 A1 4/2011 Yoon
2011/0100003 A1 5/2011 McLeod et al.
2011/0126539 A1 6/2011 Ramaswamy et al.
2011/0138809 A1 6/2011 Ramaswamy et al.
2011/0175358 A1 7/2011 Langson
2011/0272166 A1 11/2011 Hunt
2011/0314818 A1 12/2011 Breen et al.
2012/0001429 A1 1/2012 Saar et al.
2012/0042650 A1 2/2012 Ernst et al.
2012/0111004 A1 5/2012 Conry
2012/0131918 A1 5/2012 Held
2012/0145397 A1 6/2012 Schultz et al.
2012/0174581 A1 7/2012 Vaughan et al.
2012/0174622 A1 7/2012 Granier
2012/0192560 A1 8/2012 Ernst et al.
2012/0198844 A1 8/2012 Kaminsky
2012/0261092 A1 10/2012 Heath et al.
2012/0291433 A1 11/2012 Meng et al.
2012/0292112 A1 11/2012 Lakic
2012/0292909 A1 11/2012 Erikson
2012/0315158 A1 12/2012 Klaus
2013/0041068 A1 2/2013 Reddy et al.
2013/0067910 A1 3/2013 Ishiguro et al.
2013/0091843 A1 4/2013 Zyhowski et al.
2013/0129496 A1 5/2013 Eckert
2013/0139509 A1 6/2013 Berti
2013/0168089 A1 7/2013 Berg et al.
2013/0168964 A1 7/2013 Xu et al.
2013/0186089 A1* 7/2013 Bruckner ..... F03G 6/067 60/641.11
2013/0217604 A1 8/2013 Fisk, Jr.
2013/0227947 A1 9/2013 Bronicki et al.
2013/0247569 A1 9/2013 Suter
2013/0298568 A1 11/2013 Pierson et al.
2013/0299123 A1 11/2013 Matula
2013/0299170 A1 11/2013 Joseph et al.
2014/0011908 A1 1/2014 Reddy et al.
2014/0026574 A1 1/2014 Leibowitz et al.
2014/0033713 A1 2/2014 Juchymenko
2014/0057810 A1 2/2014 Fisk, Jr.
2014/0087978 A1 3/2014 Deville
2014/0102098 A1 4/2014 Bowan et al.
2014/0102103 A1 4/2014 Yamamoto
2014/0123643 A1 5/2014 Ming
2014/0130498 A1 5/2014 Randolph
2014/0158429 A1 6/2014 Kader et al.
2014/0178180 A1 6/2014 Sheridan
2014/0206912 A1 7/2014 Iglesias
2014/0224469 A1* 8/2014 Mirmobin ..... F01K 13/02 165/244
2014/0296113 A1 10/2014 Reyes et al.
2014/0305125 A1 10/2014 Wang et al.
2014/0366540 A1 12/2014 Zyhowski et al.
2015/0021924 A1 1/2015 Parella
2015/0047351 A1 2/2015 Ishikawa et al.
2015/0135708 A1 5/2015 Lutz et al.
2015/0192038 A1 7/2015 Sharp et al.
2015/0226500 A1 8/2015 Reissner et al.
2015/0252653 A1 9/2015 Shelton, Jr.
2015/0300327 A1 10/2015 Sweatman et al.
2015/0330261 A1 11/2015 Held
2015/0345341 A1 12/2015 Kacludis et al.
2015/0345482 A1 12/2015 Klitzing et al.
2015/0361831 A1 12/2015 Myers
2016/0003108 A1 1/2016 Held et al.
2016/0010512 A1 1/2016 Close
2016/0017758 A1 1/2016 Vermeersch et al.
2016/0017759 A1 1/2016 Gayawal et al.
2016/0040557 A1 2/2016 Vermeersch et al.
2016/0047540 A1 2/2016 Aumann et al.
2016/0061055 A1 3/2016 Bowan
2016/0076405 A1 3/2016 Hashimoto et al.
2016/0084115 A1 3/2016 Ludewig et al.
2016/0130985 A1 5/2016 O'Connor et al.
2016/0160111 A1 6/2016 Smith et al.
2016/0177887 A1 6/2016 Fischer
2016/0201521 A1 7/2016 Karthauser
2016/0222275 A1 8/2016 Galindo et al.
2016/0257869 A1 9/2016 Kulkarni et al.
2016/0312646 A1 10/2016 Juano
2016/0340572 A1 11/2016 Pascarella et al.
2016/0369408 A1 12/2016 Reyes et al.
2017/0058181 A1 3/2017 Frantz et al.
2017/0058722 A1 3/2017 Noureldin et al.
2017/0130614 A1 5/2017 Held et al.
2017/0145815 A1 5/2017 Cuthbert et al.
2017/0159504 A1 6/2017 Ostrom et al.
2017/0175582 A1 6/2017 McCune et al.
2017/0175583 A1 6/2017 McCune et al.
2017/0211829 A1 7/2017 Slack
2017/0226402 A1 8/2017 Patil et al.
2017/0233635 A1 8/2017 Pandey et al.
2017/0240794 A1 8/2017 Iverson et al.
2017/0254223 A1 9/2017 Goethals et al.
2017/0254226 A1 9/2017 Heber et al.
2017/0261268 A1 9/2017 Barmeier et al.
2017/0276026 A1 9/2017 Barmeier et al.
2017/0276435 A1 9/2017 Papadopoulos et al.
2017/0362963 A1 9/2017 Hostler et al.
2017/0284230 A1 10/2017 Juchymenko
2017/0314420 A1 11/2017 Bowan et al.
2017/0321104 A1 11/2017 Ravi et al.
2017/0321107 A1 11/2017 Joseph et al.

(56) References Cited

U.S. PATENT DOCUMENTS

| | | | |
|---|---|---|---|
| 2017/0370251 | A1* | 12/2017 | McGrail ..... F25B 37/00 |
| 2018/0094548 | A1 | 4/2018 | Jeter |
| 2018/0128131 | A1 | 5/2018 | Zyhowski et al. |
| 2018/0179960 | A1 | 6/2018 | Apte et al. |
| 2018/0224164 | A1 | 8/2018 | Lakic |
| 2018/0274524 | A1 | 9/2018 | Moncarz et al. |
| 2018/0313232 | A1 | 11/2018 | Auciello |
| 2018/0313340 | A1 | 11/2018 | Spadacini et al. |
| 2018/0328138 | A1 | 11/2018 | Pandey et al. |
| 2018/0340450 | A1 | 11/2018 | Avadhanula et al. |
| 2018/0355703 | A1 | 12/2018 | Al-Dossary |
| 2018/0356044 | A1 | 12/2018 | Monti et al. |
| 2019/0048759 | A1 | 2/2019 | Noureldin et al. |
| 2019/0055445 | A1 | 2/2019 | Kulkarni et al. |
| 2019/0128147 | A1 | 5/2019 | Liu |
| 2019/0128567 | A1 | 5/2019 | Redfern |
| 2019/0390660 | A1 | 12/2019 | McBay |
| 2020/0011426 | A1 | 1/2020 | Juchymenko |
| 2020/0025032 | A1 | 1/2020 | McCune et al. |
| 2020/0041071 | A1 | 2/2020 | Werlen |
| 2020/0095899 | A1 | 3/2020 | Merswolke et al. |
| 2020/0200123 | A1 | 6/2020 | Aumann et al. |
| 2020/0200483 | A1 | 6/2020 | Ahlbom |
| 2020/0217304 | A1 | 7/2020 | Sumrall |
| 2020/0232342 | A1 | 7/2020 | McCune et al. |
| 2020/0248063 | A1 | 8/2020 | Stone |
| 2020/0308992 | A1 | 10/2020 | Juchymenko |
| 2020/0309101 | A1 | 10/2020 | Muir et al. |
| 2020/0354839 | A1 | 11/2020 | Pinder et al. |
| 2020/0386212 | A1 | 12/2020 | Atisele |
| 2020/0399524 | A1 | 12/2020 | Pisklak et al. |
| 2021/0017439 | A1 | 1/2021 | Ramirez Angulo et al. |
| 2021/0047963 | A1 | 2/2021 | Conde |
| 2021/0062682 | A1 | 3/2021 | Higgins et al. |
| 2021/0071063 | A1 | 3/2021 | Stone |
| 2021/0140684 | A1 | 5/2021 | Younes et al. |
| 2021/0172344 | A1 | 6/2021 | Juchymenko |
| 2021/0205738 | A1 | 7/2021 | Blomqvist et al. |
| 2021/0285693 | A1 | 9/2021 | Gerson |
| 2021/0372668 | A1 | 12/2021 | Buscheck et al. |
| 2022/0090521 | A1 | 3/2022 | Kontomaris et al. |
| 2022/0186984 | A1 | 6/2022 | Gaia et al. |
| 2024/0026838 | A1 | 1/2024 | Bodishbaugh et al. |
| 2024/0093660 | A1 | 3/2024 | Bodishbaugh et al. |
| 2024/0159224 | A1 | 5/2024 | Bodishbaugh |
| 2024/0159225 | A1 | 5/2024 | Bodishbaugh |
| 2024/0191703 | A1 | 6/2024 | Bodishbaugh |
| 2024/0209844 | A1 | 6/2024 | Bodishbaugh |
| 2024/0218772 | A1 | 7/2024 | Bodishbaugh |
| 2024/0254973 | A1 | 8/2024 | Bodishbaugh |
| 2024/0309856 | A1 | 9/2024 | Bodishbaugh |

FOREIGN PATENT DOCUMENTS

| | | | |
|---|---|---|---|
| AU | 2011336831 | B2 | 12/2016 |
| AU | 2012306439 | B2 | 3/2017 |
| AU | 2014225990 | B2 | 7/2018 |
| CA | 2692629 | | 1/2009 |
| CA | 2698334 | | 4/2009 |
| CA | 2676502 | A1 | 2/2011 |
| CA | 2679612 | | 5/2018 |
| CA | 2676502 | | 12/2018 |
| CA | 2952379 | C | 4/2019 |
| CN | 204661610 | U | 9/2015 |
| CN | 103174473 | | 10/2015 |
| CN | 102812212 | | 4/2016 |
| CN | 103174475 | | 8/2016 |
| CN | 106517718 | | 3/2017 |
| CN | 107246550 | | 10/2017 |
| CN | 107387176 | A | 11/2017 |
| CN | 107461221 | A | 12/2017 |
| CN | 108302946 | A | 7/2018 |
| CN | 108457609 | A | 8/2018 |
| CN | 207761721 | U | 8/2018 |
| CN | 209457990 | U | 10/2019 |
| CN | 209704638 | U | 11/2019 |
| CN | 111837006 | | 10/2020 |
| CN | 111911255 | | 11/2020 |
| CN | 113137286 | A | 7/2021 |
| CN | 113266815 | A | 8/2021 |
| CN | 113983844 | A | 1/2022 |
| CN | 114370309 | A | 4/2022 |
| CN | 216922244 | U | 7/2022 |
| DE | 10337240 | A1 | 3/2005 |
| DE | 102011006066 | A1 | 9/2012 |
| DE | 102012214907 | A1 | 10/2013 |
| DE | 102012014443 | | 1/2014 |
| DE | 102013009351 | | 1/2014 |
| DE | 102018201172 | A1 | 7/2019 |
| EP | 0652368 | | 5/1995 |
| EP | 1507069 | A1 | 2/2005 |
| EP | 2530255 | A2 | 12/2012 |
| EP | 2201666 | | 3/2013 |
| EP | 1573173 | | 4/2013 |
| EP | 1713877 | | 5/2013 |
| EP | 1869293 | | 5/2013 |
| EP | 2222939 | | 11/2013 |
| EP | 1706667 | B1 | 10/2014 |
| EP | 2167872 | | 2/2016 |
| EP | 2446122 | B1 | 8/2017 |
| EP | 2478201 | B1 | 8/2017 |
| EP | 3102796 | B1 | 1/2018 |
| EP | 2550436 | B1 | 8/2019 |
| EP | 3464836 | | 4/2020 |
| EP | 3631173 | A1 | 4/2020 |
| EP | 2948649 | B1 | 12/2020 |
| EP | 3540331 | B1 | 12/2020 |
| FR | 2738872 | | 3/1997 |
| GB | 2336943 | | 6/2003 |
| IN | 247090 | | 12/2003 |
| IN | 256000 | | 1/2005 |
| IN | 202111000822 | | 10/2021 |
| JP | 08192150 | | 7/1996 |
| JP | 2001183030 | | 7/2001 |
| JP | 2009127627 | A | 6/2009 |
| JP | 2010166805 | A | 7/2010 |
| JP | 2010249501 | A | 11/2010 |
| JP | 2010249502 | A | 11/2010 |
| JP | 2011064451 | A | 3/2011 |
| JP | 4668189 | B2 | 4/2011 |
| JP | 2011069370 | A | 4/2011 |
| JP | 2011106459 | A | 6/2011 |
| JP | 2011137449 | A | 7/2011 |
| JP | 2013151931 | A | 8/2013 |
| JP | 2013238228 | A | 11/2013 |
| JP | 2014016124 | A | 1/2014 |
| JP | 2014080975 | A | 5/2014 |
| JP | 2014109279 | A | 6/2014 |
| JP | 2015149885 | A | 8/2015 |
| JP | 2016006323 | A | 1/2016 |
| JP | 2016105687 | A | 6/2016 |
| JP | 2016188640 | A | 11/2016 |
| JP | 2021167601 | A | 10/2021 |
| KR | 101126833 | | 3/2012 |
| KR | 20120067710 | | 6/2012 |
| KR | 20130023578 | A | 3/2013 |
| KR | 1691908 | | 1/2017 |
| KR | 2075550 | | 2/2020 |
| KR | 2185002 | | 12/2020 |
| NZ | 581457 | | 11/2011 |
| RU | 2006142350 | | 6/2008 |
| SG | 191467 | | 7/2013 |
| SG | 191468 | | 7/2013 |
| SG | 192327 | | 8/2013 |
| WO | 1993/001397 | | 1/1993 |
| WO | 1994028298 | | 12/1994 |
| WO | 2005014981 | A1 | 2/2005 |
| WO | 2005019606 | A1 | 3/2005 |
| WO | 2005049975 | | 6/2005 |
| WO | 2005100755 | A1 | 10/2005 |
| WO | 2006/014609 | | 2/2006 |
| WO | 2006/027770 | | 3/2006 |
| WO | 2006060253 | | 6/2006 |
| WO | 2006/092786 | | 9/2006 |

(56) References Cited

FOREIGN PATENT DOCUMENTS

| | | | |
|---|---|---|---|
| WO | 2006138459 | | 12/2006 |
| WO | 2007048999 | | 5/2007 |
| WO | 20070079245 | | 7/2007 |
| WO | 2007137373 | | 12/2007 |
| WO | 2008052809 | | 5/2008 |
| WO | 2008106774 | A1 | 9/2008 |
| WO | 2008125827 | | 10/2008 |
| WO | 2009017471 | | 2/2009 |
| WO | 2009017474 | | 2/2009 |
| WO | 2009027302 | A2 | 3/2009 |
| WO | 2009030283 | A2 | 3/2009 |
| WO | 2009/058112 | | 5/2009 |
| WO | 2009095127 | A2 | 8/2009 |
| WO | 2009/142608 | | 11/2009 |
| WO | 2010021618 | | 2/2010 |
| WO | 2010/039448 | | 4/2010 |
| WO | 2010/065895 | | 6/2010 |
| WO | 2009017473 | | 8/2010 |
| WO | 2010106089 | A2 | 9/2010 |
| WO | 2010127932 | A2 | 11/2010 |
| WO | 2010/143046 | | 12/2010 |
| WO | 2010/143049 | | 12/2010 |
| WO | 2011012047 | A1 | 2/2011 |
| WO | 2011/066032 | | 6/2011 |
| WO | 2011073469 | | 6/2011 |
| WO | 2011/061601 | | 8/2011 |
| WO | 2011/103560 | | 8/2011 |
| WO | 2011093854 | | 8/2011 |
| WO | 2011/137980 | | 11/2011 |
| WO | 2012060510 | | 5/2012 |
| WO | 2012/079694 | | 6/2012 |
| WO | 2012074940 | A2 | 6/2012 |
| WO | 2012/112889 | | 8/2012 |
| WO | 2012/142765 | | 10/2012 |
| WO | 2012/151447 | | 11/2012 |
| WO | 2013/014509 | | 1/2013 |
| WO | 2013059695 | | 4/2013 |
| WO | 2013/082575 | | 6/2013 |
| WO | 2013103592 | | 7/2013 |
| WO | 2013110375 | A2 | 8/2013 |
| WO | 2013115668 | A1 | 8/2013 |
| WO | 2013/136131 | | 9/2013 |
| WO | 2014019755 | A1 | 2/2014 |
| WO | 2014042580 | | 3/2014 |
| WO | 2014053292 | A2 | 4/2014 |
| WO | 2014059235 | A1 | 4/2014 |
| WO | 2014065977 | | 5/2014 |
| WO | 2014/124061 | | 8/2014 |
| WO | 2014/167795 | | 10/2014 |
| WO | 2014154405 | A1 | 10/2014 |
| WO | 2014159520 | A1 | 10/2014 |
| WO | 2014159587 | A1 | 10/2014 |
| WO | 2014160257 | A1 | 10/2014 |
| WO | 2014164620 | | 10/2014 |
| WO | 2014164620 | A1 | 10/2014 |
| WO | 2014165053 | | 10/2014 |
| WO | 2014165053 | A1 | 10/2014 |
| WO | 2014165144 | A1 | 10/2014 |
| WO | 2014191157 | A2 | 12/2014 |
| WO | 2015/040279 | | 3/2015 |
| WO | 2015034987 | A1 | 3/2015 |
| WO | 2015/059069 | | 4/2015 |
| WO | 2015078829 | A1 | 6/2015 |
| WO | 2015/135796 | | 9/2015 |
| WO | 2015131940 | A1 | 9/2015 |
| WO | 2015/158600 | | 10/2015 |
| WO | 2015192005 | A1 | 12/2015 |
| WO | 2016039655 | A1 | 3/2016 |
| WO | 2016049712 | | 4/2016 |
| WO | 2016050365 | A1 | 4/2016 |
| WO | 2016050366 | A1 | 4/2016 |
| WO | 2016050367 | A1 | 4/2016 |
| WO | 2016050368 | A1 | 4/2016 |
| WO | 2016050369 | A1 | 4/2016 |
| WO | 2016/069242 | | 5/2016 |
| WO | 2013103631 | | 5/2016 |
| WO | 2016073245 | A1 | 5/2016 |
| WO | 2016/087920 | | 6/2016 |
| WO | 2016099975 | A1 | 6/2016 |
| WO | 2016147419 | | 9/2016 |
| WO | 2016/196144 | | 12/2016 |
| WO | 2016204287 | | 12/2016 |
| WO | 2017041147 | | 3/2017 |
| WO | 2017065683 | | 4/2017 |
| WO | 2017123132 | | 7/2017 |
| WO | 2017/146712 | | 8/2017 |
| WO | 2017/147400 | | 8/2017 |
| WO | 2017203447 | | 11/2017 |
| WO | 2018/044690 | | 3/2018 |
| WO | 2018/107279 | | 6/2018 |
| WO | 2018106528 | | 6/2018 |
| WO | 2018/210528 | | 11/2018 |
| WO | 2018217969 | A1 | 11/2018 |
| WO | 2018227068 | A1 | 12/2018 |
| WO | 2019004910 | | 1/2019 |
| WO | 2019060844 | | 3/2019 |
| WO | 2019067618 | | 4/2019 |
| WO | 2019086960 | A1 | 5/2019 |
| WO | 3514339 | A1 | 7/2019 |
| WO | 2019/157341 | | 8/2019 |
| WO | 2019155240 | | 8/2019 |
| WO | 2019/178447 | | 9/2019 |
| WO | 2020152485 | | 7/2020 |
| WO | 2020153896 | | 7/2020 |
| WO | 2020/186044 | | 9/2020 |
| WO | 2020201843 | | 10/2020 |
| WO | 2020/229901 | | 11/2020 |
| WO | 2020/097714 | | 12/2020 |
| WO | 2020239067 | | 12/2020 |
| WO | 2020239068 | | 12/2020 |
| WO | 2020239069 | | 12/2020 |
| WO | 2020251980 | A1 | 12/2020 |
| WO | 2021004882 | | 1/2021 |
| WO | 2021013465 | A1 | 1/2021 |
| WO | 2021096696 | A1 | 5/2021 |
| WO | 2021107834 | | 6/2021 |
| WO | 2022/061320 | | 3/2022 |

OTHER PUBLICATIONS

International Search Report and Written Opinion for PCT/US2022/071482, Aug. 2, 2022.

Richter, Alexander, GreenFire Energy and Mitsui Oil Exploration Co. are partnering on a closed-loop geothermal pilot project in Japan, Think GeoEnergy, Apr. 6, 2021.

Edwards, Alex, Dallas Innovates, Hunt Energy Network's New Venture Will Put 50 Batteries Across Texas, Giving ERCOT a Portfolio of Energy Generation, Apr. 1, 2021.

Guo, Boyun, Petroleum Enginnering, A Computer-Assisted Approach, Dec. 21, 2006.

Li, Tailu et al., Cascade utilization of low temperature geothermal water in oilfield combined power generation, gathering heat tracing and oil recovery, Applied Thermal Engineering 40 (2012).

Sherven, Bob, Automation Maximizes performance for shale wells, Oil&Gas Journal, 2013.

Hu, Kaiyong et al., A case study of an ORC geothermal power demonstration system under partial load conditions in Huabei Oilfield, China, ScientDirect, 2017.

Liu, Xiaolei et al., A systematic study of harnessing low-temperature geothermal energy from oil and gas reservoirs, Elsevier, ScienceDirect, Energy, 2017.

Wang, Kai, et al., A comprehensive review of geothermal energy extraction and utilization in oilfields, Elsevier, ScienceDirect, Journal of Petroleum Science and Engineering, 2017.

Cutright, Bruce L., The Transformation of Tight Shale Gas Reservoirs to Geothermal Energy Production, Bureau of Economic Geology University of Texas, Austin Texas, Jun. 14, 2011.

Khennich, Mohammed et al., Optimal Design of ORC Systems with a Low-Temperature Heat Source, Entropy 2012, 14, 370-389; doi:10.3390/e14020370.

(56) References Cited

OTHER PUBLICATIONS

Dambly, Benjamin W., et al., The Organic Rankine Cycle for Geothermal Power Generation, Geothermal Energy, 2007.
Obi, John Besong, State of art on ORC applications for waste heat recovery and micro-cogeneration for installations up to 100kWe, Elsevier, Energy Procedia 82 ( 2015 ) 994-1001.
Obafunmi, Jaiyejeje Sunday, Thermodynamic Analysis of Organic Rankine Cycles, Eastern Mediterranean University Jul. 2014, Gazimağusa, North Cyprus.
Dong, Bensi et al., Potential of low temperature organic Rankine cycle with zeotropic mixtures as working fluid, Elsevier, ScienceDirect, Energy Procedia 105 ( 2017 ) 1489-1494.
Iqbal, MdArbab et al., Trilateral Flash Cycle (TFC): a promising thermodynamic cycle for low grade heat to power generation, Elsevier, ScienceDirect, Energy Procedia 160 (2019) 208-214.
Bao, Junjiang et al., A review of working fluid and expander selections for organic Rankine cycle, Elsevier, ScienceDirect, Renewable and Sustainable Energy Reviews 24 (2013) 325-342.
Ajimotokan, Habeeb A. et al., Trilateral Flash Cycle for Recovery of Power from a Finite Low-Grade Heat Source, Proceedings of the 24th European Symposium on Computer Aided Process Engineering—ESCAPE 24 Jun. 15-18, 2014, Budapest, Hungary. Copyright© 2014 Elsevier B.V.
Hung Tzu-Chen, et al., The Development and Application of a Small-Scale Organic Rankine Cycle for Waste Heat Recovery, IntechOpen, 2019.
Kong, Rithy et al., Thermodynamic performance analysis of a R245fa organic Rankine cycle (ORC) with different kinds of heat sources at evaporator, Elsevier, ScienceDirect, Case Studies in Thermal Engineering 13 (2019) 100385.
Lukawski, Maciej Z. et al., Impact of molecular structure of working fluids on performance of organic Rankine cycles (ORCs), Sustainable Energy Fuels, 2017, 1, 1098.
Saleh, Bahaa et al., Working fluids for low-temperature organic Rankine cycles, Elsevier, ScienceDirect, Energy 32 (2007) 1210-1221.
Brasz, Lars J. et al., Ranking of Working Fluids for Organic Rankine Cycle Applications, Purdue University, Purdue e-Pubs, (2004). International Refrigeration and Air Conditioning Conference. Paper 722.
Miller, Patrick C., Research uses landfill gas tech for Bakken flaring solution, The Bakken magazine, Sep. 16, 2015.
ElectraTherm, Inc., Power+ Generator 4400B & 4400B+, Nov. 24, 2020.
ElectraTherm, Inc., Heat To Power Generation Base Load Renewable Energy, Mar. 2020.
ElectraTherm, Inc., Power+ Generator, Nov. 25, 2020.
ElectraTherm, Inc., Generating Clean Power From Waste Heat, Nov. 2020.
ElectraTherm, Inc., Power+ Generator, May 19, 2020.
Sneary, Loy et al., Gulf Coast Green Energy, Flare Gas Reduction Trial Using an Organic Rankine Cycle Generator, Jan. 11, 2016.
Enertime, ORC for Industrial Waste Heat Recovery, Aug. 2017.
Enogia, Generate power from your waste heat thanks to our ORC, 2019.
UTC Power, PureCycle, 200 Heat-to-Electricity Power System, 2004.
Rank, MT3 machine, Dec. 17, 2018.
Heat Recovery Solutions, Clean Cycle Containerized Solution, 2009.
Triogen BV, Specification: E-Box Engine Application, Feb. 15, 2019.
"From Waste Heat To High Performance", PBOG (Permian Basin Oil and Gas Magazine), Apr. 26, 2013.
"Turning Waste Heat Into Clean Power; GNP's Expander System", Great Northern Power Corporation, 2022.
Ng et al., "Thermo-Economic Performance of an Organic Rankine Cycle System Recovering Waste Heat Onboard an Offshore Service Vessel", Journal of Marine Science and Engineering, May 14, 2020.
"First Flare Elimination Demonstration", ElectraTherm, 2022.
International Search Report and Written Opinion for PCT/US2022/071472, May 9, 2022.
International Search Report and Written Opinion for PCT/US2022/071475, May 17, 2022.
International Search Report and Written Opinion for PCT/US2022/071474, Jun. 10, 2022.
International Search Report and Written Opinion for PCT/US2022/071486, Jun. 14, 2022.
International Search Report and Written Opinion for PCT/US2022/071323, Jun. 28, 2022.
International Search Report and Written Opinion for PCT/US2022/071325, Jun. 28, 2022.
Invitation to Pay Additional Fees and Communication Relating to Results of Partial International Search for PCT/US2022/071329, mailed Jun. 27, 2022.
Invitation to Pay Additional Fees and Communication Relating to Results of Partial International Search for PCT/US2022/071327, mailed Jul. 4, 2022.
International Search Report and Written Opinion for PCT/US2022/071313, Jul. 5, 2022.
International Search Report and Written Opinion for PCT/US2022/071517, Jun. 27, 2022.
International Search Report and Written Opinion for PCT/US2022/071484, Jun. 27, 2022.
International Search Report and Written Opinion for PCT/US2022/071319, Jul. 12, 2022.
International Search Report and Written Opinion for PCT/US2022/071327, Aug. 29, 2022.
International Search Report and Written Opinion for PCT/US2022/071328, Sep. 9, 2022.
International Search Report and Written Opinion for PCT/US2022/071329, Aug. 25, 2022.
Li et al., "Thermodynamic analysis of subcritical/transcritical ORCs with metal-organic heat carriers for efficient power generation from low-grade thermal energy", Energy 255 (2022) 124519.

* cited by examiner

SYSTEMS AND METHODS TO UTILIZE HEAT CARRIERS IN CONVERSION OF THERMAL ENERGY

CROSS REFERENCE TO RELATED APPLICATIONS

This application claims priority to and the benefit of U.S. Provisional Application No. 63/478,012, filed Dec. 30, 2022, titled "SYSTEMS AND METHODS TO UTILIZE HEAT CARRIERS IN CONVERSION OF THERMAL ENERGY," the disclosure of which is incorporated herein by reference in its entirety.

FIELD OF DISCLOSURE

Embodiments of this disclosure relate to generating additional heat and electrical power output, as well as increasing efficiency, of a closed-loop thermal cycle device or system. More particularly, embodiments of systems or methods may utilize heat carriers, such as metal organic frameworks or metal organic heat carriers, to generate additional heat and/or increase work output based on adsorption and/or desorption at varying locations within the closed-loop thermal cycle device or system.

BACKGROUND

In some instances, an organic Rankine cycle (ORC) generator or unit or other closed-loop thermal cycle device may include a working fluid loop that flows to a heat source, such that the heat from the heat source causes the working fluid in the loop to change phases from a liquid to a vapor. The vaporous working fluid may then flow to a gas expander, causing the gas expander to rotate. The rotation of the gas expander may cause a generator to generate electrical power. The vaporous working fluid may then flow to a condenser or heat sink. The condenser or heat sink may cool the working fluid, causing the working fluid to change phase from the vapor to the liquid. The working fluid may circulate through the loop in such a continuous manner, thus the ORC generator or unit, or other closed-loop thermal cycle device, may generate electrical power.

SUMMARY

Accordingly, Applicants have recognized a need for embodiments of systems and methods to generate power via a closed-loop thermal cycle device injected with an amount of heat carriers. The present disclosure is directed to embodiments of such systems and methods.

As noted, for example, a closed-loop thermal cycle device may generate electrical power via, for example, a thermal cycle operation based on heat transfer to a working fluid (e.g., such as via an organic Rankine cycle). Various types of sources of heat may be utilized, but some heat sources may offer inconsistent amounts of heat over time. Further, some heat sources may offer minimal amounts of heat nearing a threshold at which electrical power may be produced. Thus, heat carriers, e.g., nanonmaterials or nanoparticles, such as metal organic frameworks (MOFs) or metal organic heat carriers, may be injected into the closed-loop of the closed loop thermal cycle device and/or in a closed-loop defined by a path between the closed-loop of the closed-loop thermal cycle device and an intermediate heat exchanger, for example. The heat carriers may adsorb and/or desorb the working fluid. As the heat carrier desorbs and/or adsorbs working fluid, additional heat may be generated. For example, heat generated by adsorption in a pump of the closed-loop thermal cycle device may generate heat and substitute and/or generate external work input, thus increasing the efficiency of the pump and reducing the overall electrical power utilized by the closed-loop thermal cycle device. In another example, desorption of the working fluid by the heat carrier in an evaporator may generate additional heat. In yet another example, adsorption of the working fluid by the heat carrier in the turbine or expander may provide extra work output.

While the introduction of the heat carriers are beneficial in relation to the generation of heat and work output, several issues may occur based on the use of such heat carriers. The heat carriers may be nanoparticles. The heat carriers may be comprised of metal nanoparticles comprising various shapes, such as, for example, one, two, or three dimensional shapes or structures. The heat carriers may include characteristics, as noted, that cause the heat carriers to adsorb and/or desorb working fluid under specified environments (e.g., based on temperature, pressure, and/or flow). The heat carriers also may cause various issues, such as cavitation in pumps; binding, pitting, and/or erosion in expanders; settling of flow streams in a heat exchanger; clogging of filters; attaching to lubricating oil in the expander; and/or falling out of flow streams in piping. Thus, embodiments of the closed-loop thermal cycle device disclosed herein may be arranged structurally to solve such issues, while utilizing the beneficial properties (e.g., increase in heat and/or work output) of the heat carriers, as will be understood by those skilled in the art.

In an embodiment, for example, the closed-loop thermal cycle device may include an evaporator, a pump, a condenser, an expander, and a loop. The loop may be a fluid path defined by the evaporator, the pump, the condenser, and the expander. Further, the loop may include an injection point position thereon and configured to allow a specified amount and type of heat carrier to be injected into the loop. The type of heat carrier may be selected based on the type of working fluid utilized in the loop and/or based on the conditions or expected conditions within the loop (e.g., pressure, temperature, and/or flow rate of various points within the loop). Upon introduction of the amount of heat carrier within the loop, the closed-loop thermal cycle device may generate electrical power, for example, at a lower than typical temperature utilized in similar closed-loop thermal cycle devices without heat carriers.

In the closed-loop thermal cycle device, the pump may be designed or configured to be less sensitive to cavitation. For example, to reduce cavitation sensitivity, the pump may include a net positive suction head available greater than the net positive head required plus three feet or more; the pump may be operated at a lower temperature; the liquid level may be raised in the suction vessel of the pump (e.g., by ensuring that there is a sufficient amount of working fluid in the actual loop of the closed-loop thermal cycle device); the pump may utilize reduced motor rotations per minute of one or more flow control devices; the pump may utilize an impeller inducer; and/or the pump may include an increased diameter of an eye of the impeller, among other methods to decrease risks associated with cavitation.

Further, to prevent binding, pitting, and/or erosion, potentially caused by the small tolerances for an expander, for example, the tolerances of the expander may be adjusted or, in another embodiment, the type of heat carrier may be selected based on the tolerances of the expander. Additionally, the internal geometry of the evaporator (e.g., heat exchangers) and/or piping may be arranged structurally such that heat carriers flow through the evaporator and/or piping without eroding surfaces and/or clumping or mounding therein. For example, the internal geometries may include less sharp angles and more rounded curves. The internals of the evaporator and/or piping may also be coated to prevent erosion. Further, the friction inside the piping and/or evaporator may be reduced to additionally solve such issues. Further, filters used in the closed-loop thermal cycle device may be configured to address similar issues (e.g., a 25 micron filter may be utilized, while the heat carriers are about 1 to about 10 microns in size).

Additionally, oil or expander lubricant may attract the heat carriers. As such, the oil or expander lubricant, for example, may be selected to not be overly attractive to the heat carrier. In another embodiment, a centrifuge and/or filter may be connected to the expander. As the amount of heat carriers attracted to the oil or expander lubricant reaches a specified threshold, the oil or expander lubricant with the heat carrier may be transported to the centrifuge and/or filter. The centrifuge and/or filter may separate the oil or expander lubricant from the heat carrier. The separated heat carrier may be re-introduced or re-injected into the loop, while the oil or expander lubricant may be transported back to the expander.

Accordingly, embodiments of the disclosure are directed to a system for converting thermal energy to electrical power. The system may comprise a closed-loop thermal cycle device. The closed-loop thermal cycle device may include an evaporator. The evaporator may include a first fluid path to accept and output a flow of heated fluid and a second fluid path to accept and output a flow of a working fluid and configured to indirectly transfer heat from the flow of heated fluid to the flow of working fluid to cause the working fluid to change phases from a liquid to a vapor. The closed-loop thermal cycle device may include a condenser to cool the flow of the working fluid to cause the working fluid to change phases from the vapor to the liquid. The closed-loop thermal cycle device may include a pump to transport the liquid state working fluid from the condenser for heating. The closed-loop thermal cycle device may include an expander to generate electrical power via rotation by vapor state working fluid. The closed-loop thermal cycle device may include a loop for the flow of the working fluid defined by a fluid path through the evaporator, condenser, pump, and expander. The closed-loop thermal cycle device may include an injection point positioned along the loop. The system may include an amount of heat carrier injected into the loop via the injection point and configured to adsorb and desorb the working fluid and, upon desorption and adsorption respectively, generate additional heat to increase output of electrical power.

In an embodiment, the heated fluid may comprise one or more of a compressed gas at a pumping station, a wellhead fluid at a wellsite, a drilling fluid at a wellsite, engine exhaust, or fluid from an engine's water jacket.

In an embodiment, the system may include one or more sensors positioned along the loop. The one or more sensors may be positioned to prevent clumping or mounding of the amount of heat carriers about the one or more sensors. In an embodiment, the one or more sensors may be positioned at one or more of an input of the second fluid path of the evaporator, an output of the second fluid path of the evaporator, an input of the condenser, an output of the condenser, within the pump, within the expander, or within portions of the loop. The one or more sensors may comprise one or more of temperature sensors, pressure sensors, pressure transducers, or flow meters. In another embodiment, the closed-loop thermal cycle device may include an extraction point and a valve positioned at the extraction point and configured to control heat carrier and working fluid to flow from the loop. The system may include a separator connected to the valve positioned at the extraction point and configured to separate the heat carrier from the working fluid. Separated working fluid may be transported back to the loop and separated heat carrier may be transported to a heat carrier storage area. The heat carrier storage area may comprise a tank.

The valve positioned at the extraction point may be configured to, in response to a determination that a pressure detected by any one of the one or more sensors exceeds a selected pressure threshold indicating a potential blockage or clog, adjust to an open position to cause heat carrier and working fluid to flow therethrough. The injection point may be configured to, in response to a determination that a temperature detected by any one of the one or more sensors is less than or equal to a selected temperature threshold indicating a temperature less than sufficient to cause the flow of working fluid to change phases from liquid to gas, increase an amount of heat carrier injected into the loop. The valve positioned at the extraction point may be configured to, in response to a determination that a flow rate detected by any one of the one or more sensors is less than a selected flow rate threshold indicating a potential blockage or clog, adjust to an open position to cause heat carrier and working fluid to flow therethrough. The separator may comprise one or more of a centrifuge or a filter.

In an embodiment, the heat carrier may comprise a metal organic framework or metal organic heat carrier. In another embodiment, the heat carrier may adsorb working fluid within the pump to thereby increase heat within the pump to substitute as a portion of external work output. The heat carrier may desorb working fluid in the evaporator to thereby cause desorbed working fluid to extract additional heat from the heated fluid. The heat carrier may adsorb working fluid within the expander to thereby increase heat in the expander and increasing work output of the expander.

In an embodiment, the pump may be configured to exhibit lower sensitivity to cavitation and seals corresponding to the pump may be configured to withstand damage caused by the heat carrier.

In another embodiment, each particle of the amount of heat carrier may be about 1 micron to 10 micron. In an embodiment, the heat carrier may be selected to prevent damage to the expander based on tolerances therein. Internal geometries of the evaporator and loop may be configured to prevent one or more of clumping, buildup, or erosion therein.

In another embodiment, a selected oil lubricates the expander. The selected oil may attract a portion of the amount of heat carrier, The selected oil and the portion of the amount of heat carrier may be transported to a centrifuge or filter. The centrifuge or filter may separate the selected oil from the heat carrier. The selected oil may be transported to the expander and separated heat carrier may be injected into the loop via the injection point.

In another embodiment, the closed-loop thermal cycle device may comprise an organic Rankine cycle device, a Rankine cycle device, a Kalima cycle device, Goswami cycle device, Bell Coleman cycle device, Carnot cycle device, Ericsson cycle device, Hygroscopic cycle device, Scuderi cycle device, Stirling cycle device, Manson cycle device, or Stoddard cycle device, among other thermal cycle devices which utilize thermal energy to generate electricity.

Another embodiment of the disclosure is directed to a method for converting thermal energy to electrical power via a closed-loop thermal cycle device. The method may include, during a closed-loop thermal cycle device operation, injecting a predetermined amount of heat carrier into a loop of a closed loop thermal cycle device; generating electrical power based on heat transferred to a working fluid and the amount of heat carrier, via an evaporator, to cause the working fluid to change phases from a liquid to a vapor, the vapor to cause an expander to generate the electrical power; monitoring characteristics of the closed-loop thermal cycle device at a plurality of locations within the loop. The method may also include, in response to determination that one of the characteristics is outside of a pre-selected threshold range, injecting an additional amount of heat carrier into the loop.

The method may also include, during the closed-loop thermal cycle device operation: determining whether expander lubricant attracts a portion of the amount of heat carrier. The method may also include, in response to a determination that the expander lubricant attracted the portion of the amount of heat carrier: separating the expander lubricant from the portion of the amount of heat carrier; injecting separated heat carrier into the loop; and injecting the expander lubricant into the expander.

In another embodiment, the method may include collecting the working fluid and heat carrier at an extraction point positioned along the loop; separating the heat carrier from the working fluid, and injecting the working fluid separated from the heat carrier into the loop.

In an embodiment, the characteristics may include one or more of pressure, flow rate, or temperature. The heat carrier may adsorb and desorb working fluid within the loop and, based on adsorption and desorption, increase heat within the loop.

Another embodiment of the disclosure is directed to a controller to control conversion of thermal energy to electrical power via a closed-loop thermal cycle device injected with an amount of heat carrier. The controller may include a first set of one or more inputs in signal communication with a corresponding one of one or more temperature sensors positioned along a loop of the closed-loop thermal cycle device and to provide a temperature of working fluid at a position of the loop. The controller may include a first input/output, each of the inputs/outputs in signal communication with a heat carrier injection valve. The controller may be configured to, during a closed-loop thermal cycle device operation, in response to any temperature of the working fluid at any position of the loop being less than a selected threshold, transmit a signal to cause the heat carrier injection valve to inject an amount of heat carrier in the loop. In another embodiment, an additional amount of heat carrier may be injected into the loop based on periodically measured temperatures of the working fluid.

Still other aspects and advantages of these embodiments and other embodiments, are discussed in detail herein. Moreover, it is to be understood that both the foregoing information and the following detailed description provide merely illustrative examples of various aspects and embodiments, and are intended to provide an overview or framework for understanding the nature and character of the claimed aspects and embodiments. Accordingly, these and other objects, along with advantages and features of the present invention herein disclosed, will become apparent through reference to the following description and the accompanying drawings. Furthermore, it is to be understood that the features of the various embodiments described herein are not mutually exclusive and may exist in various combinations and permutations.

BRIEF DESCRIPTION OF DRAWINGS

These and other features, aspects, and advantages of the disclosure will become better understood with regard to the following descriptions, claims, and accompanying drawings. It is to be noted, however, that the drawings illustrate only several embodiments of the disclosure and, therefore, are not to be considered limiting of the scope of the disclosure.

DETAILED DESCRIPTION

Figure 1A:
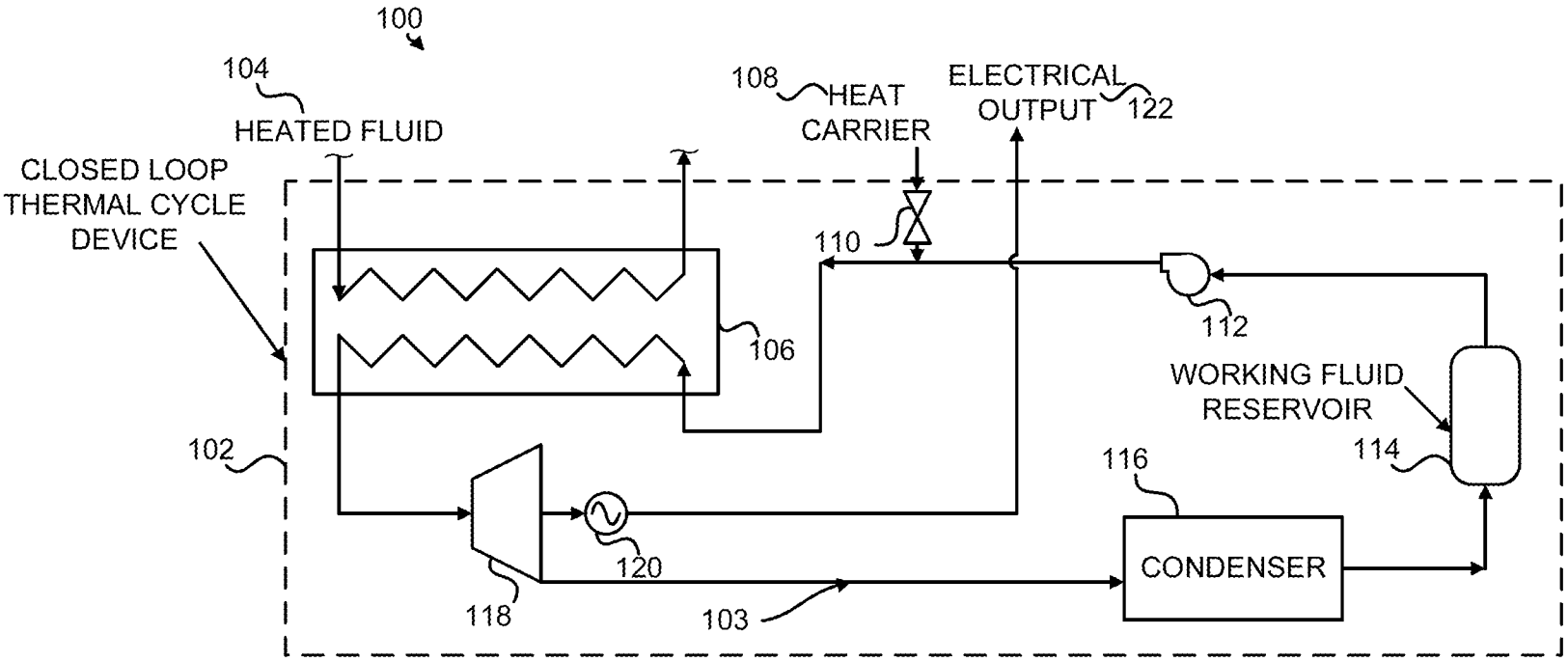
FIG. 1A, FIG. 1B, FIG. 1C, FIG. 1D, FIG. 1E, FIG. 1F, FIG. 1G, and FIG. 1H are block diagrams illustrating example implementations of power generation via a closed-loop thermal cycle device injected with heat carriers, according to one or more embodiments of the disclosure.

So that the manner in which the features and advantages of the embodiments of the systems and methods disclosed herein, as well as others that will become apparent, may be understood in more detail, a more particular description of embodiments of systems and methods briefly summarized above may be had by reference to the following detailed description of embodiments thereof, in which one or more are further illustrated in the appended drawings, which form a part of this specification. It is to be noted, however, that the drawings illustrate only various embodiments of the systems and methods disclosed herein and are therefore not to be considered limiting of the scope of the systems and methods disclosed herein as it may include other effective embodiments as well.

Accordingly, Applicants have recognized a need for embodiments of systems and methods to generate power via a closed-loop thermal cycle device injected with an amount of heat carriers. The present disclosure is directed to embodiments of such systems and methods.

As noted, for example, a closed-loop thermal cycle device may generate electrical power via, for example, a thermal cycle operation based on heat transfer to a working fluid (e.g., such as via an organic Rankine cycle). Various types of sources of heat may be utilized, but some heat sources may offer inconsistent amounts of heat over time. Further, some heat sources may offer minimal amounts of heat nearing a threshold at which electrical power may be produced. Thus, heat carriers, e.g., nanonmaterials or nanoparticles, such as metal organic frameworks (MOFs) or metal organic heat carriers, may be injected into the closed-loop of the closed loop thermal cycle device and/or in a closed-loop defined by a path between the closed-loop of the closed-loop thermal cycle device and an intermediate heat exchanger, for example. The heat carriers may adsorb and/or desorb the working fluid. As the heat carrier desorbs and/or adsorbs working fluid, additional heat may be generated. For example, heat generated by adsorption in a pump of the closed-loop thermal cycle device may generate heat and substitute and/or generate external work input, thus increasing the efficiency of the pump and reducing the overall electrical power utilized by the closed-loop thermal cycle device. In another example, desorption of the working fluid by the heat carrier in an evaporator may generate additional heat. In yet another example, adsorption of the working fluid by the heat carrier in the turbine or expander may provide extra work output.

While the introduction of the heat carriers are beneficial in relation to the generation of heat and work output, several issues may occur based on the use of such heat carriers. The heat carriers may be nanoparticles. The heat carriers may be comprised of metal nanoparticles comprising various shapes, such as, for example, one, two, or three dimensional shapes or structures. The heat carriers may include characteristics, as noted, that cause the heat carriers to adsorb and/or desorb working fluid under specified environments (e.g., based on temperature, pressure, and/or flow). The heat carriers also may cause various issues, such as cavitation in pumps; binding, pitting, and/or erosion in expanders; settling of flow streams in a heat exchanger; clogging of filters; attaching to lubricating oil in the expander; and/or falling out of flow streams in piping. Thus, embodiments of the closed-loop thermal cycle device disclosed herein may be arranged structurally to solve such issues, while utilizing the beneficial properties (e.g., increase in heat and/or work output) of the heat carriers, as will be understood by those skilled in the art.

In an embodiment, for example, the closed-loop thermal cycle device may include an evaporator, a pump, a condenser, an expander, and a loop. The loop may be a fluid path defined by the evaporator, the pump, the condenser, and the expander. Further, the loop may include an injection point position thereon and configured to allow a specified amount and type of heat carrier to be injected into the loop. The type of heat carrier may be selected based on the type of working fluid utilized in the loop and/or based on the conditions or expected conditions within the loop (e.g., pressure, temperature, and/or flow rate of various points within the loop). Upon introduction of the amount of heat carrier within the loop, the closed-loop thermal cycle device may generate electrical power, for example, at a lower than typical temperature utilized in similar closed-loop thermal cycle devices without heat carriers.

In the closed-loop thermal cycle device, the pump may be designed or configured to be less sensitive to cavitation. For example, to reduce cavitation sensitivity, the pump may include a net positive suction head available greater than the net positive head required plus three feet or more; the pump may be operated at a lower temperature; the liquid level may be raised in the suction vessel of the pump (e.g., by ensuring that there is a sufficient amount of working fluid in the actual loop of the closed-loop thermal cycle device); the pump may utilize reduced motor rotations per minute of one or more flow control devices; the pump may utilize an impeller inducer; and/or the pump may include an increased diameter of an eye of the impeller, among other methods to decrease risks associated with cavitation.

Further, to prevent binding, pitting, and/or erosion, potentially caused by the small tolerances for an expander, for example, the tolerances of the expander may be adjusted or, in another embodiment, the type of heat carrier may be selected based on the tolerances of the expander. Additionally, the internal geometry of the evaporator (e.g., heat exchangers) and/or piping may be arranged structurally such that heat carriers flow through the evaporator and/or piping without eroding surfaces and/or clumping or mounding therein. For example, the internal geometries may include less sharp angles and more rounded curves. The internals of the evaporator and/or piping may also be coated to prevent erosion. Further, the friction inside the piping and/or evaporator may be reduced to additionally solve such issues. Further, filters used in the closed-loop thermal cycle device may be configured to address similar issues (e.g., a 25 micron filter may be utilized, while the heat carriers are about 1 to about 10 microns in size).

Additionally, oil or expander lubricant may attract the heat carriers. As such, the oil or expander lubricant, for example, may be selected to not be overly attractive to the heat carrier. In another embodiment, a centrifuge and/or filter may be connected to the expander. As the amount of heat carriers attracted to the oil or expander lubricant reaches a specified threshold, the oil or expander lubricant with the heat carrier may be transported to the centrifuge and/or filter. The centrifuge and/or filter may separate the oil or expander lubricant from the heat carrier. The separated heat carrier may be re-introduced or re-injected into the loop, while the oil or expander lubricant may be transported back to the expander.

FIG. 1A, FIG. 1B, FIG. 1C, FIG. 1D, FIG. 1E, FIG. 1F, and FIG. 1G are block diagrams illustrating novel implementations of power generation via a closed-loop thermal cycle device injected with heat carriers, according to one or more embodiment of the disclosure. Turning first to FIG. 1A, a closed-loop thermal cycle device 102 may include a number of components. For example, the system 100 or closed-loop thermal cycle device 102 may include various components, devices, or apparatuses, such as temperature sensors, pressure sensors or transducers, flow meters, control valves, smart valves, valves actuated via control signal, controllers, a master or supervisory controller, other computing devices, computing systems, user interfaces, in-field equipment, and/or other equipment as will be understood by those skilled in the art. More particularly, the closed-loop thermal cycle device 102 may include an evaporator 106 or heat exchanger. The evaporator 106 may include two fluid paths. A heated fluid 104 from a heat source may flow in one direction, while a working fluid may flow in the opposite direction. Heat may be transferred indirectly within the evaporator 106 from the heated fluid 104 to the working fluid, causing the working fluid to change phases from a liquid to a vapor. The evaporator 106 may comprise a shell and tube heat exchanger, a spiral plate or coil heat exchanger, a heliflow heat exchanger, or other heat exchanger. As noted, the evaporator 106 may be designed and/or configured to prevent erosion within the evaporator 106. Further, the internal geometry of the loop 103 may also be configured to prevent erosion within the loop 103. Such a configuration may include coating the interior surfaces of the evaporator 106 and/or loop 103, including rounded corners or piping, and/or reducing friction within the evaporator 106 and/or loop 103. Other components may be configured similarly, such as the expander 118, condenser 116, working fluid reservoir 114, and other components.

Prior to the working fluid entering the evaporator 106, a selected amount of heat carriers 108 may be injected, via a valve 110, into the loop 103. While a particular location is illustrated in in FIG. 1A, it will be understood that the amount of heated carriers 108 may be injected at other locations. The selected amount of heat carriers 108 may mix with the working fluid. At varying locations within the loop 103, the working fluid may be adsorbed or desorbed by the amount of heat carriers 108. The type and amount of heat carrier 108 may be selected based on the type of working fluid utilized within the loop 103, the amount of pressure within the loop 103, the expected or predicted temperature within the loop 103, and/or a current or expected flow rate of working fluid within the loop 103.

Prior to injection (and/or after injection has occurred) of the amount of heat carriers 108 into the loop 103 and working fluid, the working fluid may pass through pump 112. The pump 112 may increase the flow rate of the working fluid within the loop 103. As noted, the pump 112 may be configured to include higher cavitation tolerances or decreased cavitation sensitivities. For example, the pump 112 may be configured to include a net positive suction head available greater than the net positive head required plus three feet or more. The liquid level in the loop 103 may be increased, such that the liquid level is raised in the suction vessel of the pump 112. In another embodiment, to ensure that the pump 112 has higher cavitation sensitivities, the pump 112 may include utilizing reduced motor rotations per minute, utilizing an impeller inducer, and/or increase the diameter of an eye of the impeller, among other methods to decrease chances of cavitation.

The closed-loop thermal cycle device 102 may also include a working fluid reservoir 114 to store an amount of working fluid in the loop 103 in a liquid state to ensure continuous or substantially continuous operations. The closed-loop thermal cycle device 102 may also include a condenser 116, heat sink regenerator, fin fan cooler, a sing-pass parallel flow heat exchanger, a 2-pass crossflow heat exchanger, a 2-pass countercurrent heat exchanger, or other type of apparatus or some combination thereof. The condenser 116 may cool vapor from the expander 118, causing the vapor state working fluid to change phases to a liquid.

As working fluid is heated in the evaporator 106, the working fluid may change phases from a liquid to a vapor. The vapor may flow to the expander 118 and cause the expander 118 to generate an electrical output 122 via a connected generator 120. The expander 118 may comprise a gas expander, a turbine expander, a positive displacement expander, a scroll expander, a screw expander, a twin-screw expander, a vane expander, a piston expander, another volumetric expander, and/or any other expander suitable for a thermal/electrical cycle. The heat carrier 108 may, when the working fluid changes phase from a liquid to a vapor, flow to the expander 118. In an example, the working fluid vapor may include bubbles. The heat carrier 108 may adhere to the bubbles. Based on the concentration of heat carrier in the working fluid, an amount of heat carrier 108 may adhere to the bubbles sufficient to overcome liquid tension, causing the heat carrier 108 to flow to the expander 118. In an example where such liquid tension is not overcome or if the number of heat carriers 108 is too great, then a bypass line with a valve may be added to aid in transporting heat carriers 108 past the expander 118.

Figure 1B:
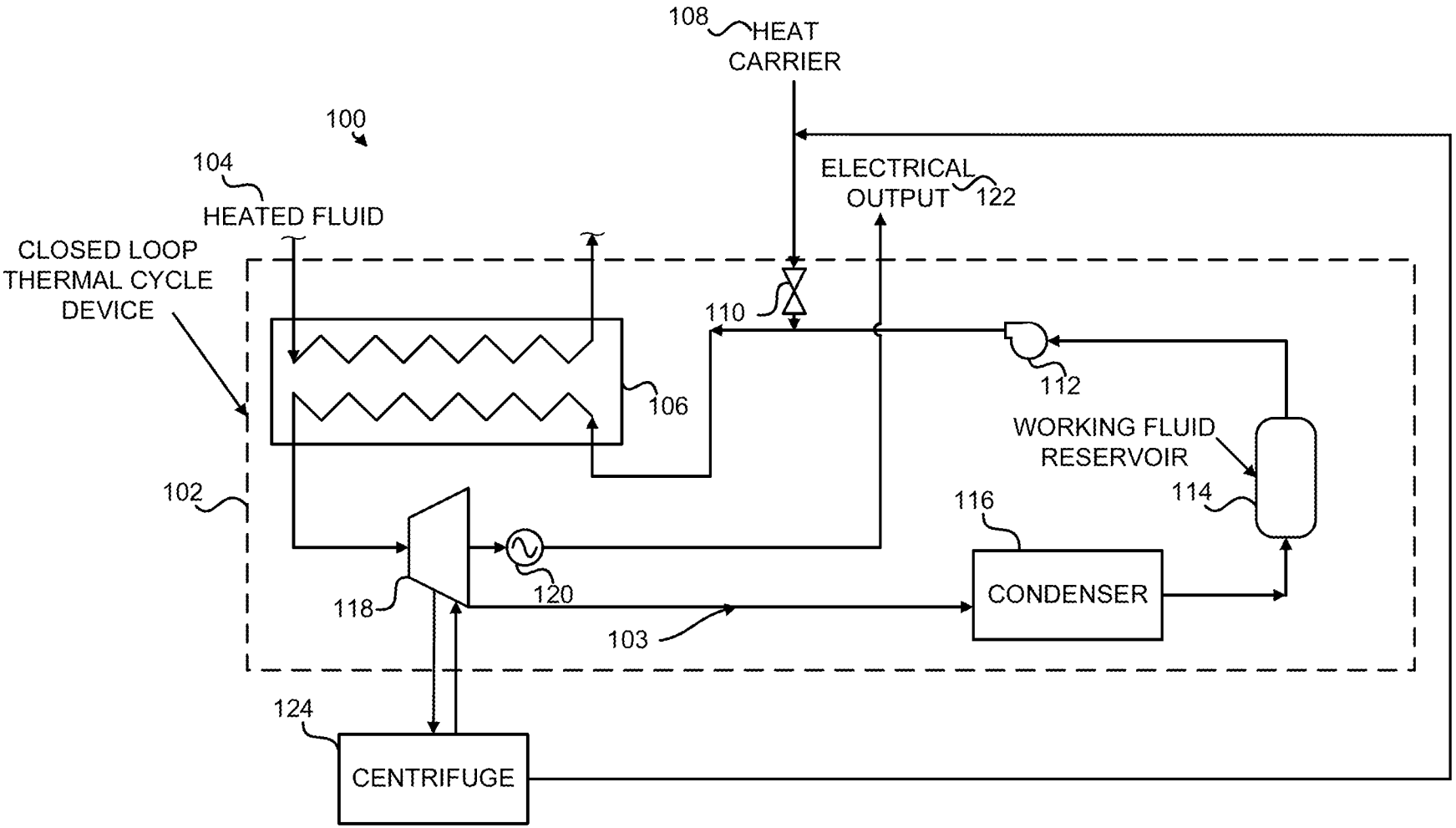

In an embodiment, the expander 118 may be lubricated with a selected oil. The oil may be selected based on various properties, such as the ability to not attract the heat carriers 108. However, such a selection may not occur. Thus, some of the heat carriers 108 may be attracted to the expander lubricant. In such embodiments, as illustrated in FIG. 1B, the closed-loop thermal cycle device 102 and/or system 100 may include a centrifuge 124. Prior to transport, the amount of heat carrier 108 attached to the expander lubricant may be determined and, if that amount exceeds a threshold, the expander lubricant may be transported to the centrifuge 124. In another embodiment, rather than determining an amount of heat carrier 108, the expander lubricant may be periodically passed to the centrifuge 124. The centrifuge 124 may separate the heat carrier 108 from the expander lubricant. The expander lubricant may be injected back into or added back into the expander 118. The heat carrier 108 may be injected back into the loop 103 and/or may be stored in a heat carrier 108 storage area or tank.

Figure 1C:
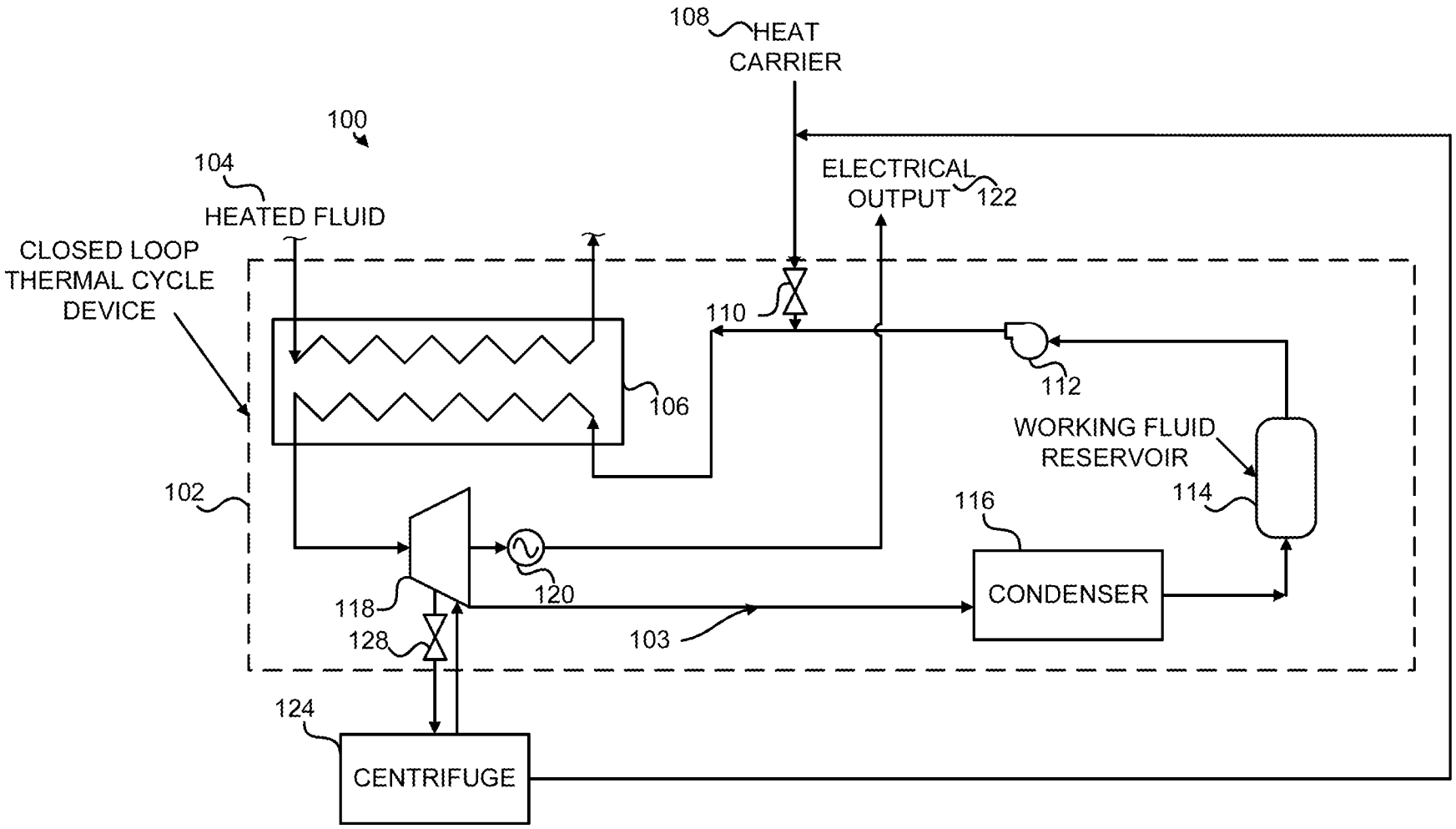

Turning to FIG. 1C, the flow of expander lubricant with heat carrier 108 may be controlled by a valve 128 or control valve. When the conditions described above are met (e.g., a specified time period has lapsed and/or an amount of heat carriers has attached to the expander lubricant), the valve 128 may open or be adjusted to an open position to allow the expander lubricant and attached heat carriers 108 to flow therethrough.

Figure 1D:
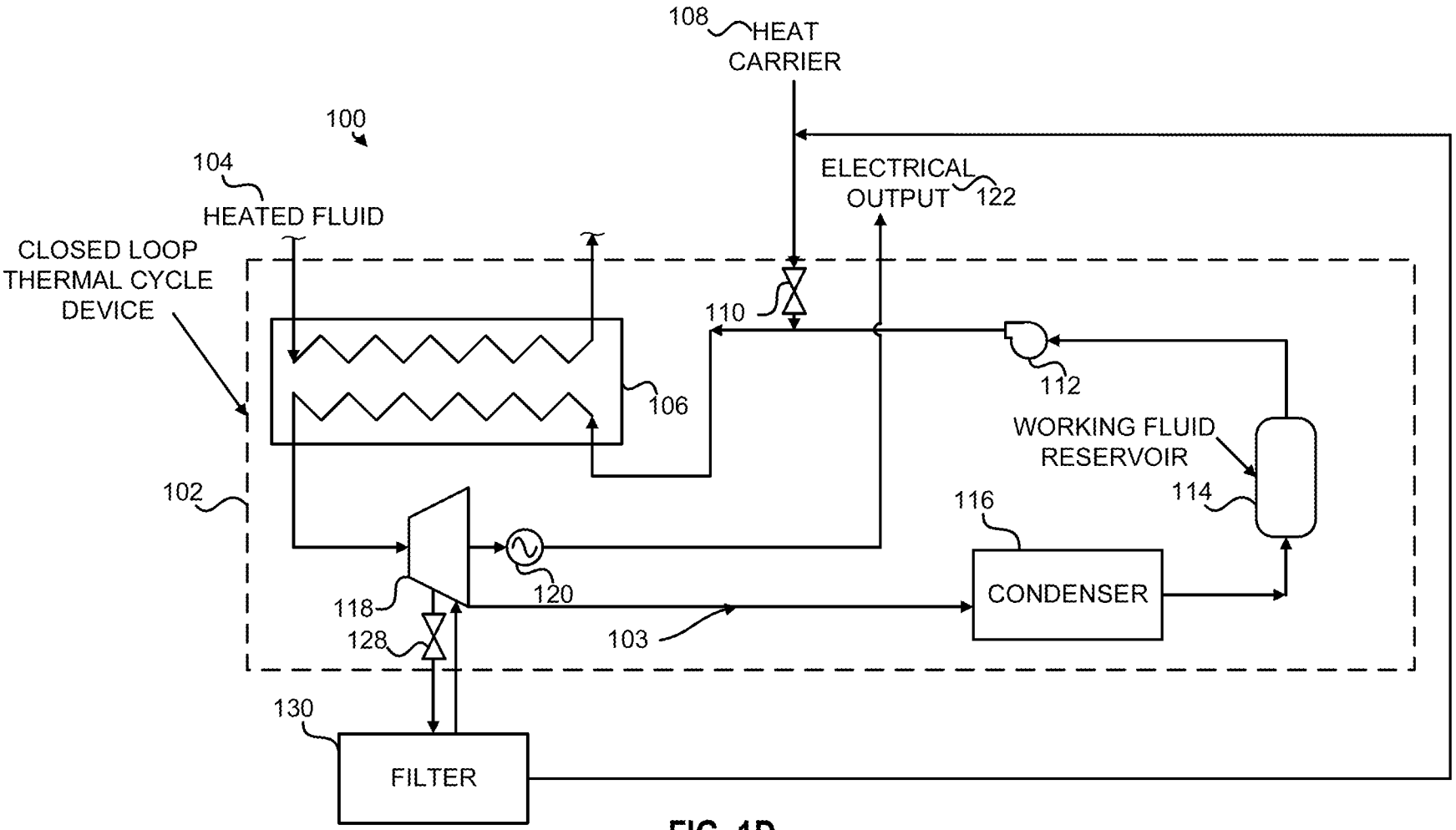

Turning to FIG. 1D, rather than or in addition to the centrifuge, the expander lubricant and heat carriers 108 may be separated by a filter 130. In other embodiments, other types of separators may be utilized, such as settlers, magnets, and/or other separators capable of separating a metal particle from an oil, as will be understood by one skilled in the art.

Figure 1E:
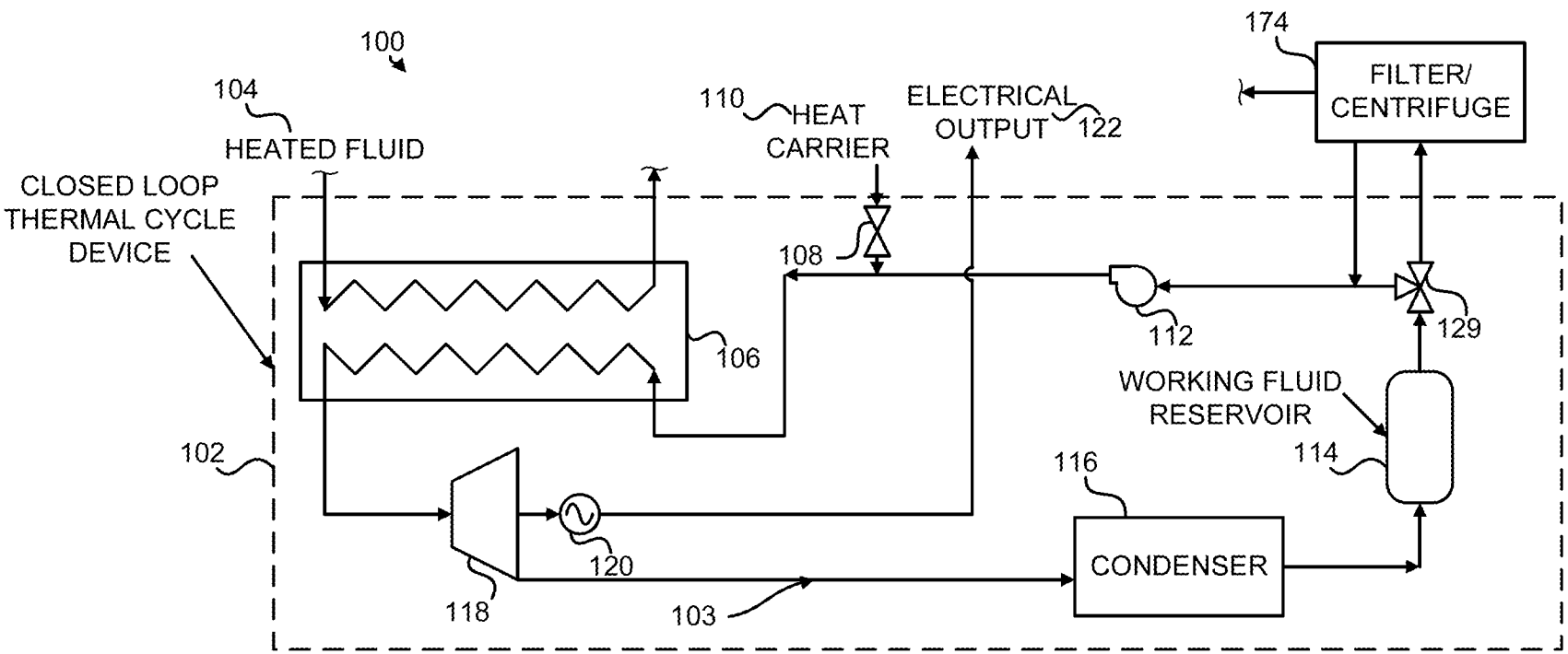

Turning to FIG. 1E, a filter/centrifuge 174, or other separator, may be utilized to remove the heat carriers from the loop 103. In an embodiment, the heat carriers 108 may at some point clump, cause pump cavitation, erode piping, and/or cause other issues. The filter/centrifuge 174, in such embodiments, may be utilized to remove the heat carrier from the working fluid to return the closed-loop thermal cycle device 102 to typical operations. Such conditions may be determined based on a number of factors, such as a decrease in pressure, fluctuations in temperature, and/or a decrease in flow rate. Such conditions may be determined based on one or more sensors positioned throughout the system 100 (e.g., see FIG. 1H). Further, if any of the conditions described are met, the valve 129 may adjust to a position to allow the working fluid and heat carrier 108 mixture to flow to the filter/centrifuge 174. After separation of the working fluid and heat carrier 108 occurs, the working fluid may be transported back to the loop 103, while the heat carrier 108 may be stored in a heat carrier storage area or tank or may be re-injected into the loop 103 at a later time (e.g., after issue diagnosis and resolution).

Figure 1F:
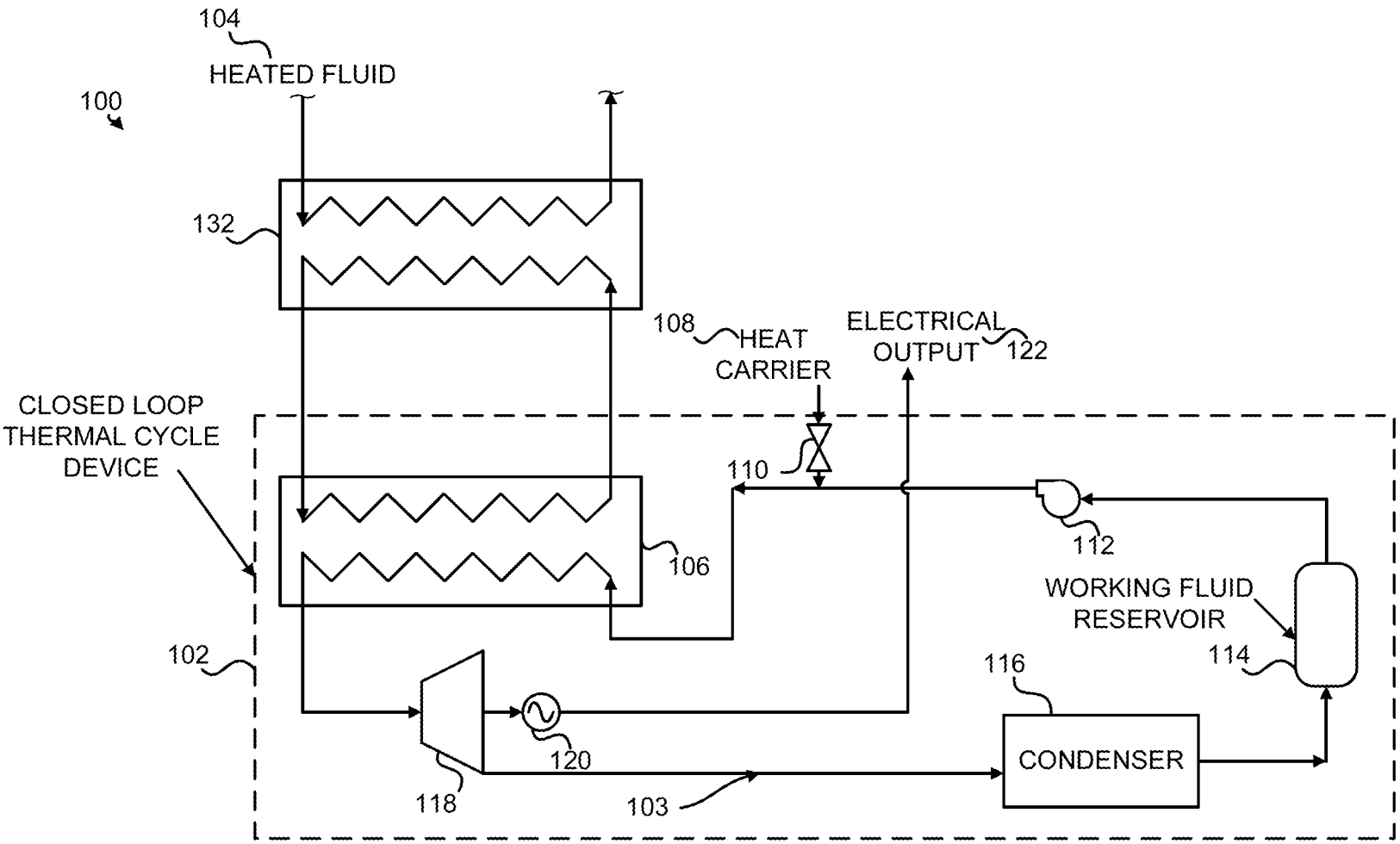

Turning to FIG. 1F, the system 100 may include an intermediate heat exchanger 132. In such examples, the intermediate heat exchanger 132 may be a high temperature, high pressure, and/or other type of heat exchanger. The intermediate heat exchanger 132 may include a closed-loop filled with an intermediate working fluid, such as water or a glycol mixture, among others. The intermediate heat exchanger 132 may transfer heat from a heat source to the intermediate working fluid. The intermediate heat exchanger 132 may ensure (via sensors and/or valves) that the intermediate working fluid does not change from a liquid to a vapor, but that the intermediate working fluid carries heat to the closed-loop thermal cycle device 102. In another embodiment, the working fluid in the loop 103 may comprise organic working fluid and/or one or more of pentafluoropropane, carbon dioxide, ammonia and water mixtures, tetrafluoroethane, isobutene, propane, pentane, perfluorocarbons, and other hydrocarbons.

Figure 1G:
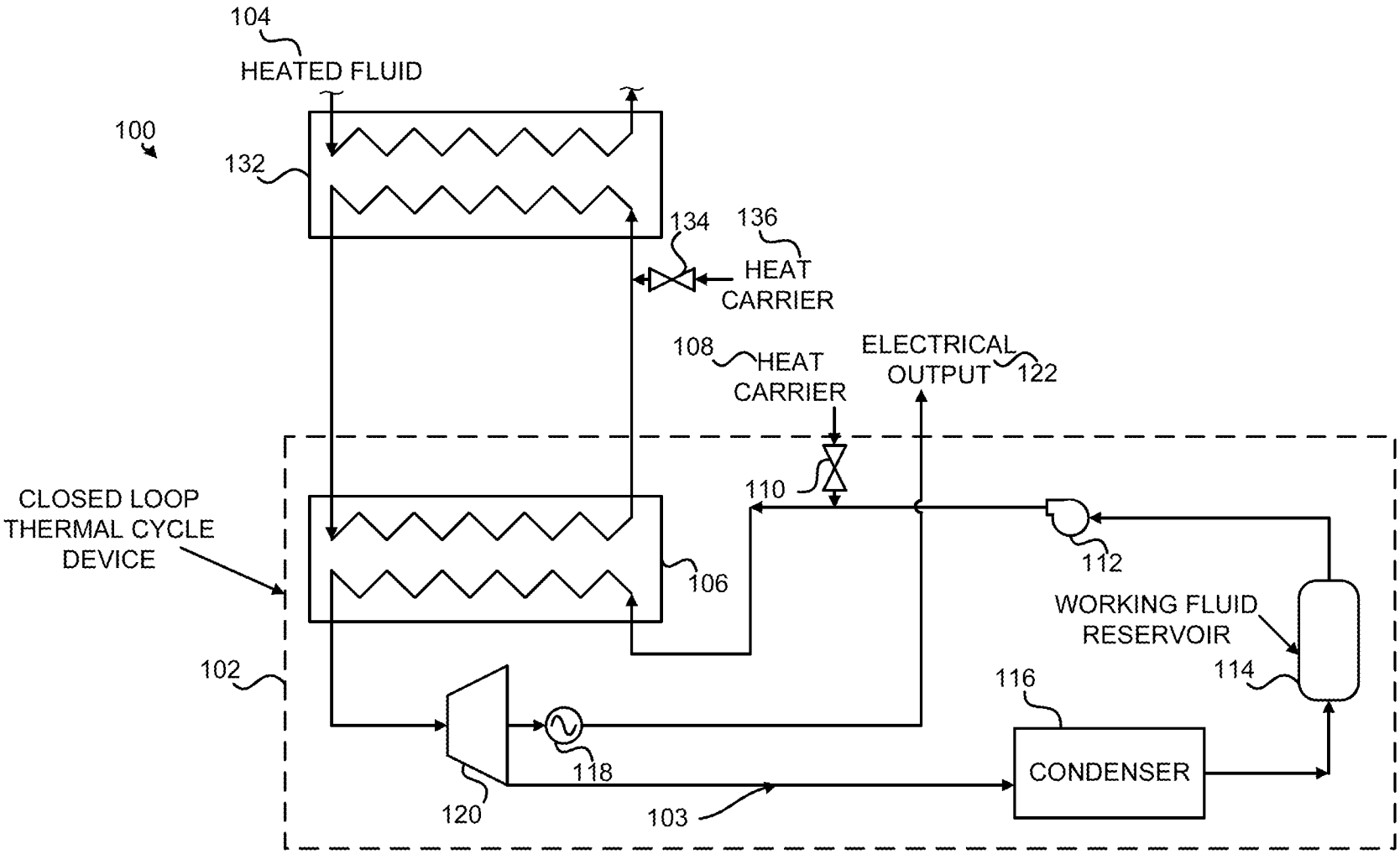

Turning to FIG. 1G, the intermediate loop of the intermediate heat exchanger 132 may include heat carriers 136 or heat carriers 136 may be added to the intermediate loop (e.g., via valve 134). In such embodiments, the closed-loop thermal cycle device 102 may or may not include heat carriers 108. Further, the heat carriers 136 may increase the heat collected in the intermediate heat exchanger 132 and increase the heat transferred, via the evaporator 106, to the working fluid of the closed-loop thermal cycle device 102.

Figure 1H:
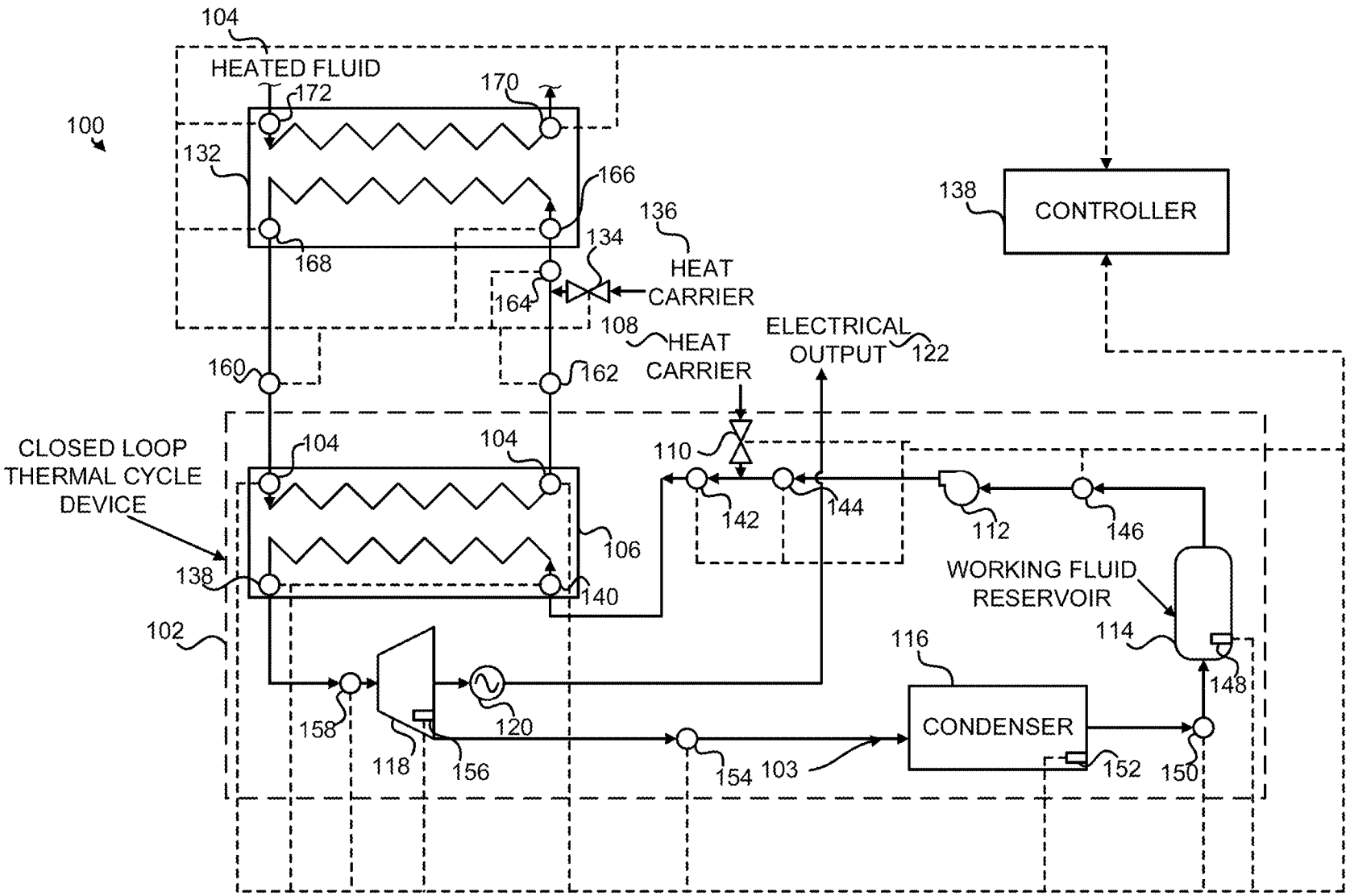

Turning to FIG. 1H, sensors (e.g., sensors 138, 140, 142, 144, 146, 148, 150, 152, 154, 156, 158, 160, 162, 164, 166, 168, 170, and 172) may be positioned throughout the system 100 and connected to a controller 138. The sensors may provide various details on the closed-loop thermal cycle device 102, as well as the intermediate heat exchanger 132. For example, the sensors may provide operating conditions of each component (e.g., evaporator 106, pump 112, working fluid reservoir 114, condenser 116, and/or the expander 118, as well as the intermediate heat exchanger 132). Based on various characteristics, the amount to heat carriers added or removed to the system 100 may vary. For example, if the temperature in the closed-loop thermal cycle device 102 is below selected threshold (e.g., for example, below a temperature at which electrical power is generated), then the controller 138 may cause additional heat carrier 108 and/or heat carrier 136 to be added into the system 100. In another example, the transport of expander lubricant and heated carrier may be adjusted by the controller 138 based on the operating conditions of the expander 118 (e.g., electrical power output, efficiency, temperature, and/or other characteristics indicating operating issues with the expander 118.

In an embodiment, The electrical power output 122 may be transferred to or utilized by the equipment at the site, to an energy storage device (e.g., if excess power is available), to equipment at other nearby sites, to the grid or grid power structure (e.g., via a transformer through power lines), to other types of equipment (e.g., cryptographic currency and/or block chain miners, hydrolyzers, carbon capture machines, nearby structures such as residential or business structures or buildings, and/or other power destinations), or some combination thereof.

In an embodiment, the heat carrier 108 may be a metal organic framework or a metal organic heat carrier. The heat carriers 108 may be considered nanoparticles. The heat carriers 108 may be about 1 micron to about 10 microns. The heat carriers 108 may comprise Mg-MOF-74 or Chromium (Cr)-MIL-101.

Figure 2A:
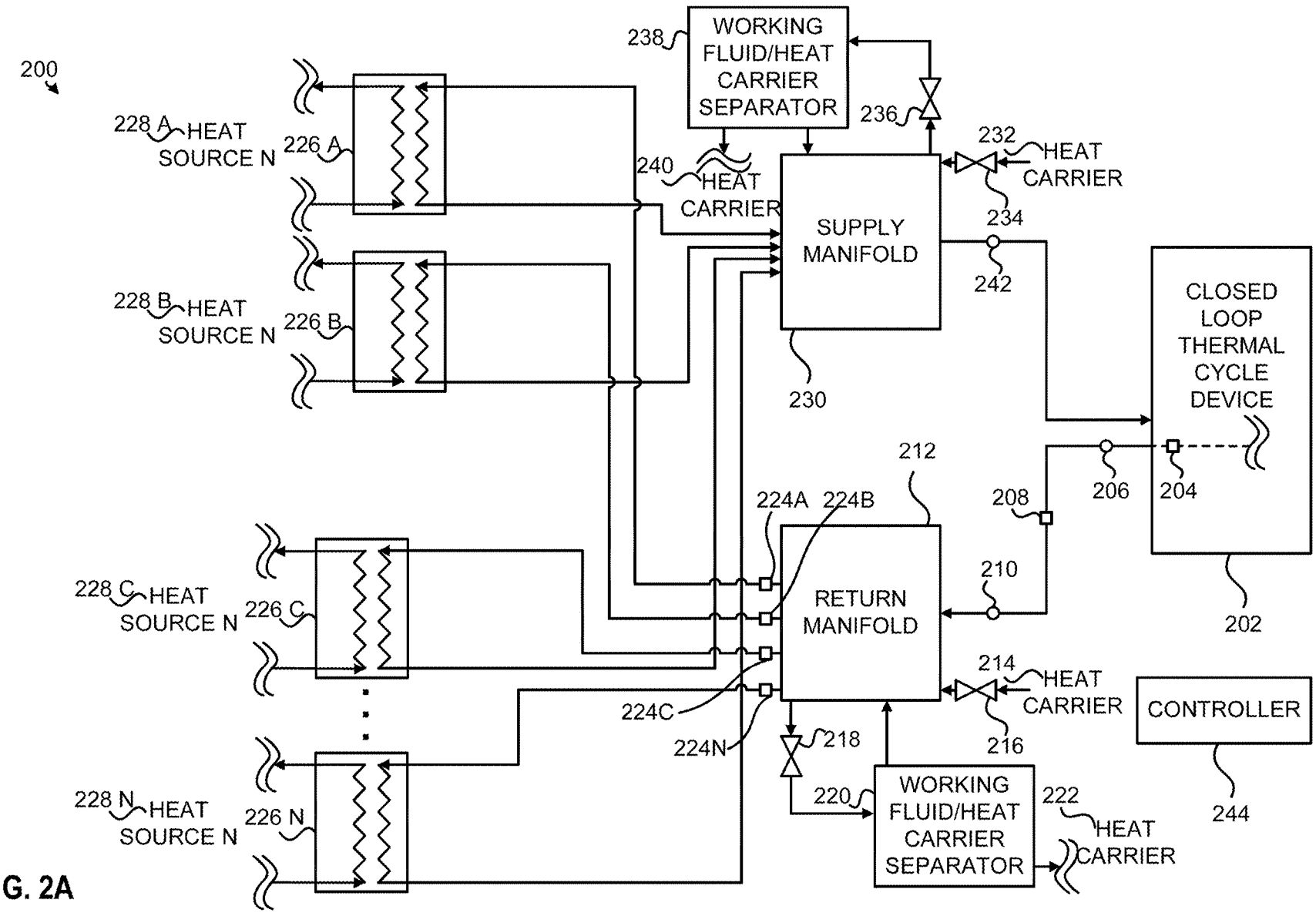
FIG. 2A and FIG. 2B are block diagrams illustrating implementations of systems of an electrical power generating closed-loop thermal cycle device and intermediate heat exchangers injected with heat carriers, according to one or more embodiments of the disclosure.
Figure 2B:
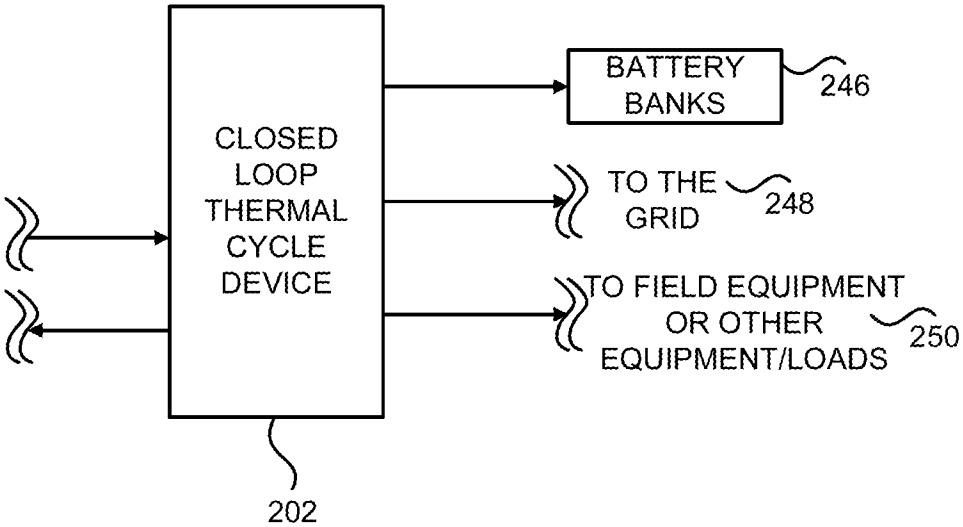

FIG. 2A and FIG. 2B are block diagrams illustrating implementations of systems of an electrical power generating closed-loop thermal cycle device and intermediate heat exchangers injected with heat carriers, according to one or more embodiment of the disclosure. Similar to the system 100 illustrated in FIGS. 1F through 1H, the closed-loop thermal cycle device 202 may connect to a plurality of intermediate heat exchangers 226A, 226B, 226C, and up to 226N. The system 200 may manage the working fluid flowing between each of the intermediate heat exchangers 226A, 226B, 226C, and up to 226N and the closed-loop thermal cycle device 202 via a return manifold 212 and a supply manifold 230.

The flow control devices 208 between the return manifold 212 and the closed-loop thermal cycle device 202 may be a pump, while the flow control device 204 within the closed-loop thermal cycle device 202 may be a pump. The flow control devices 224A, 224B, 224C, up to 224N, 208, and 204 used throughout the system 200 may be pumps or variable speed pumps. The flow control devices 224A, 224B, 224C, up to 224N, 208, and 204 may include some combination of one or more control valves and/or one or more pumps. In an embodiment, the one or more flow control devices 224A, 224B, 224C, up to 224N, 208, and 204 may include one or more of a fixed speed pump, a variable speed drive pump, a control valve, an actuated valve, or other suitable device to control flow of a fluid.

In an embodiment, heat carriers 214, 232 may be added to the system 200 to increase heat generation and/or pump efficiency. As illustrated, the heat carriers 214, 232 may be introduced at the return manifold 212 and the supply manifold via valves 216, 234. While these injection locations are illustrated, it will be understood that heat carriers may be injected in varying other locations of the system 200. Temperature, pressure, and/or flow may be monitored via controller 244. The heat carrier 214, 232 may be removed, added, or adjusted based on determination made by the controller 244.

In an embodiment, the closed-loop thermal cycle device 202 may generate electrical power. The electrical power may be provided to battery banks 246, to the grid 248, and/or to field equipment or other equipment/loads 250.

Figure 3:
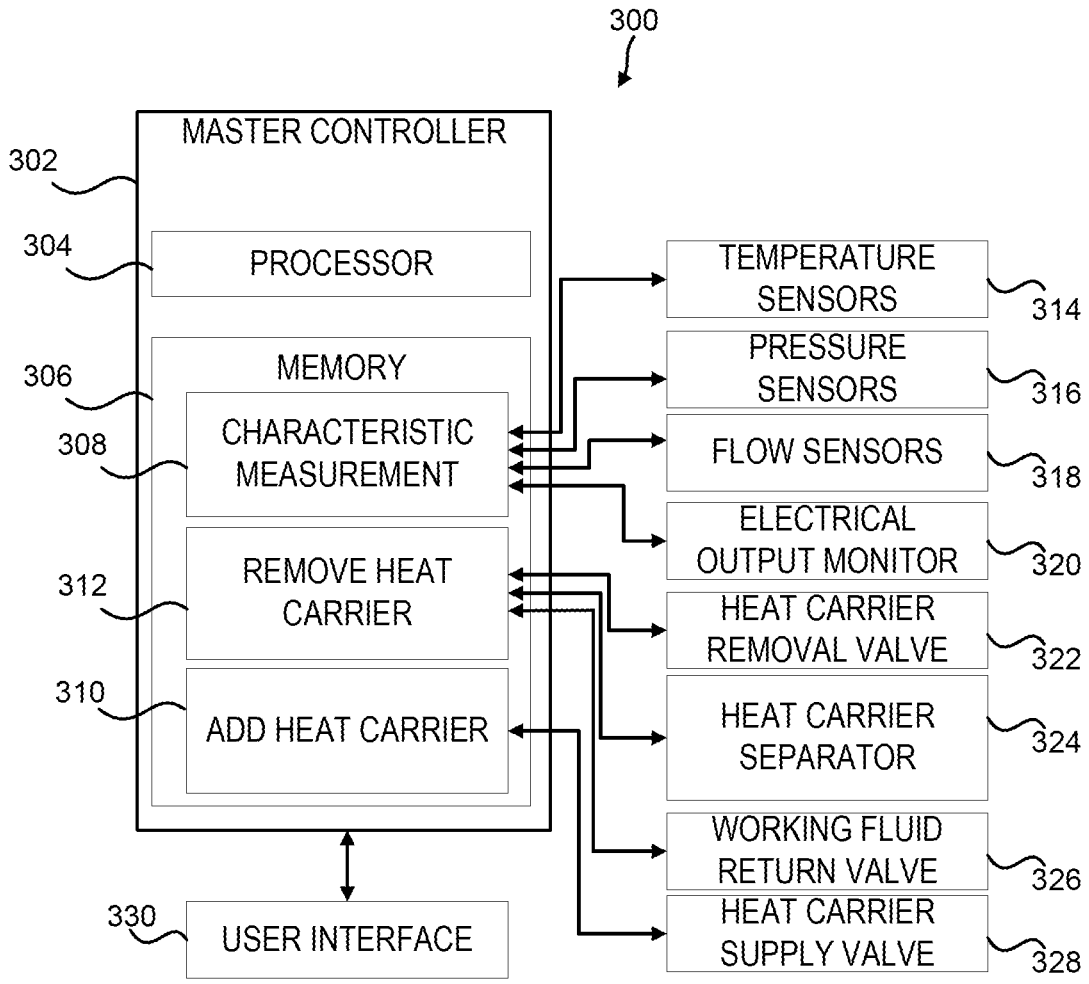
FIG. 3 is a simplified diagram illustrating a control system for managing a closed-loop thermal cycle device and/or intermediate heat exchangers injected with heat carriers, according to one or more embodiments of the disclosure.

FIG. 3 is a simplified diagram illustrating a control system for managing a closed-loop thermal cycle device and/or intermediate heat exchangers injected with heat carriers, according to one or more embodiments of the disclosure. A master controller 302 may manage the operations of electrical power generation via a the closed-loop thermal cycle device injected with a heat carrier. The master controller 302 may be one or more controllers, a supervisory controller, programmable logic controller (PLC), a computing device (such as a laptop, desktop computing device, and/or a server), an edge server, a cloud based computing device, and/or other suitable devices. The master controller 302 may be located at or near the drilling rig. The master controller 302 may be located remote from the facility. The master controller 302, as noted, may be more than one controller. In such cases, the master controller 302 may be located near or at the drilling rig, various facilities and/or at other off-site locations. The master controller 302 may include a processor 304, or one or more processors, and memory 306. The memory 306 may include instructions. In an example, the memory 306 may be a non-transitory machine-readable storage medium. As used herein, a "non-transitory machine-readable storage medium" may be any electronic, magnetic, optical, or other physical storage apparatus to contain or store information such as executable instructions, data, and the like. For example, any machine-readable storage medium described herein may be any of random access memory (RAM), volatile memory, non-volatile memory, flash memory, a storage drive (e.g., hard drive), a solid state drive, any type of storage disc, and the like, or a combination thereof. As noted, the memory 306 may store or include instructions executable by the processor 304. As used herein, a "processor" may include, for example one processor or multiple processors included in a single device or distributed across multiple computing devices. The processor may be at least one of a central processing unit (CPU), a semiconductor-based microprocessor, a graphics processing unit (GPU), a field-programmable gate array (FPGA) to retrieve and execute instructions, a real time processor (RTP), other electronic circuitry suitable for the retrieval and execution instructions stored on a machine-readable storage medium, or a combination thereof.

As used herein, "signal communication" refers to electric communication such as hard wiring two components together or wireless communication for remote monitoring and control/operation, as understood by those skilled in the art. For example, wireless communication may be Wi-Fi®, Bluetooth®, ZigBee, cellular wireless communication, satellite communication, or forms of near field communications. In addition, signal communication may include one or more intermediate controllers or relays disposed between elements that are in signal communication with one another.

The master controller 302 may include instructions 308 to measure characteristics within the closed-loop thermal cycle device. The master controller 302 may include a set of inputs (e.g., a first set of inputs, a second set of inputs, etc.). The master controller 302 may connect to the one or more sensors via such a connection. The master controller 302 may connect to temperature sensors 314, pressure sensors 316, flow rate sensors 318, and/or an electrical power output monitor 320 via the sets of inputs. The master controller 302 may obtain the characteristic measurements periodically, continuously, substantially continuously, and/or at selected time intervals (e.g., for example, a time interval entered in the user interface 330 by a user).

The master controller 302 may include instructions 310 to add heat carriers to the closed-loop thermal cycle device. The instructions 310, in such an example, when executed may cause the controller to determine whether one or more temperatures measured within the closed-loop thermal cycle device are below a selected threshold. The master controller 302 may, if any of the one or more temperatures are below the selected thresholds, adjust a heat carrier supply valve 328 to cause heat carrier to flow into the closed-loop thermal cycle device. Such an operation may cause the temperature and/or work output of the closed-loop thermal cycle device to increase.

The master controller 302 may include instructions 312 to remove heat carriers from the closed-loop thermal cycle device. The instructions 312, when executed, may cause the master controller 302 to determine whether any of the measured characteristics are outside of one or more selected threshold ranges. If any of the characteristics are outside of the selected threshold ranges, then the master controller 302 may adjust a heat carrier removal valve to cause the heat carrier to flow to a heat carrier separator. The master controller 302 may then initiate a separation operation.

In an embodiment, instructions 312 may be executed when an amount of heat carrier is attracted to or attached to expander lubricant. In such examples, an expander lubricant valve may be opened, allowing the expander lubricant to flow to the heat carrier separator 324. The expander lubricant and heat carrier may then be separated and utilized for other purposes (e.g., the expander lubricant is transported back to the expander, while the heat carrier may be transported back to the closed-loop thermal cycle device).

Figure 4A:
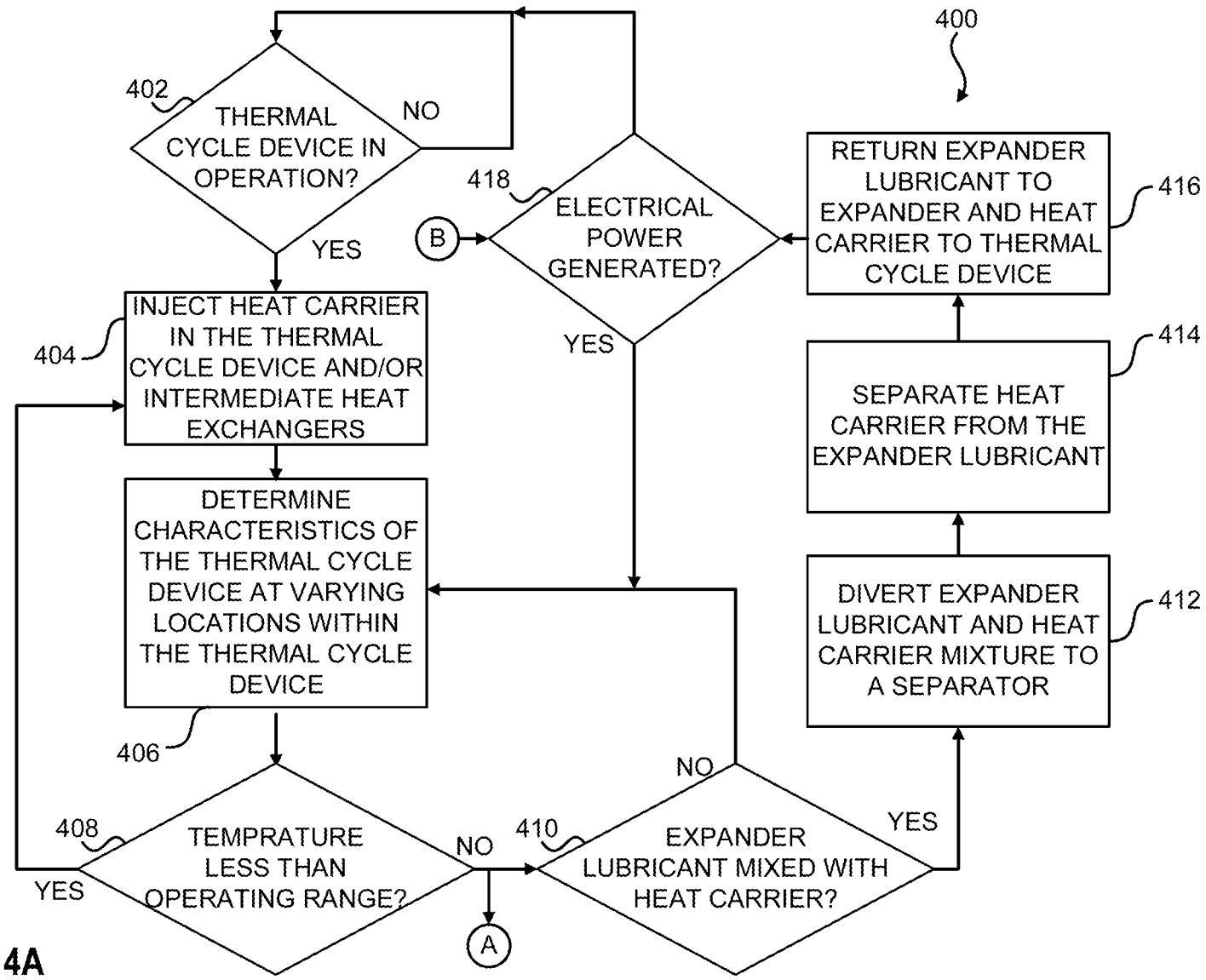
FIG. 4A and FIG. 4B are flow diagrams of a method of electrical power generation in a closed-loop thermal cycle device with heat carriers, according to one or more embodiments of the disclosure.
Figure 4B:
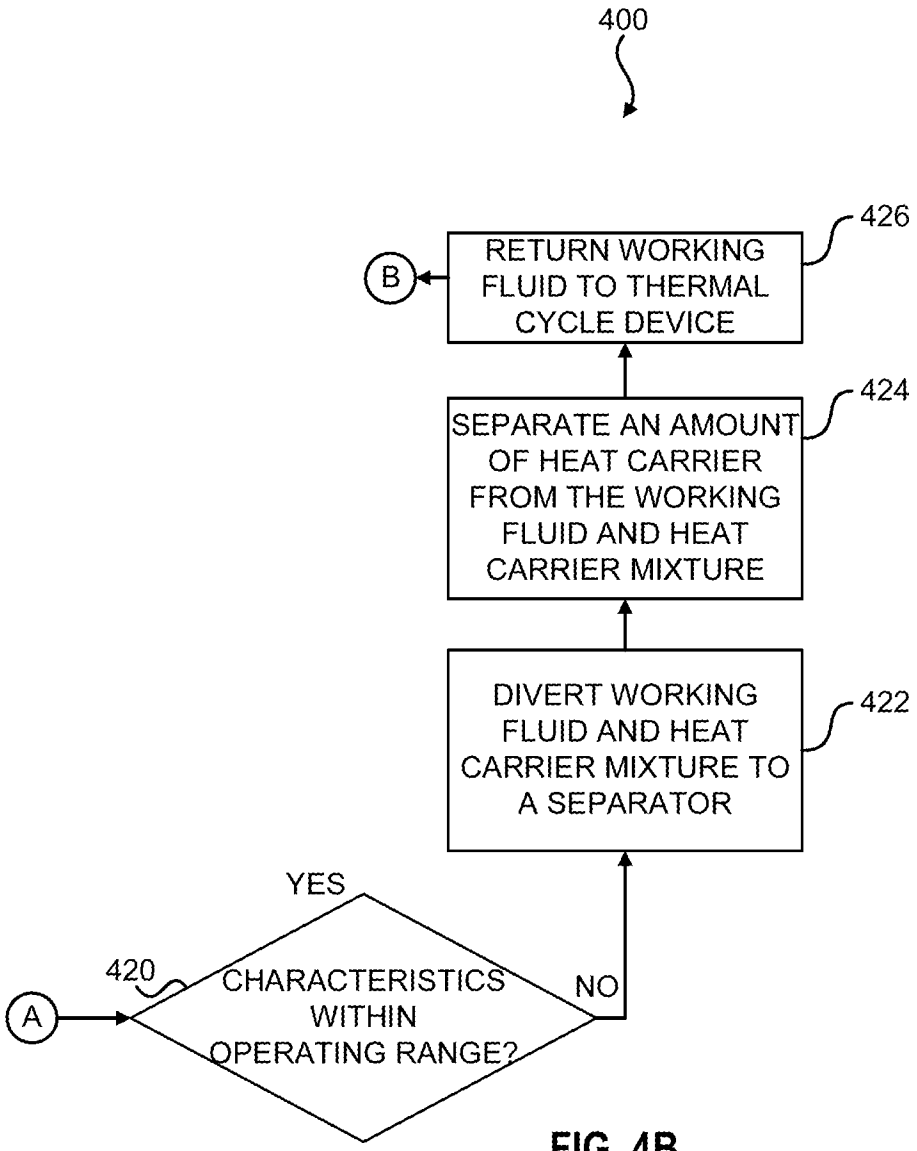

FIG. 4 is a flow diagram of a method of electrical power generation in a closed-loop thermal cycle device with heat carriers, according to one or more embodiments of the disclosure. The method is detailed with reference to the master controller 302. Unless otherwise specified, the actions of method 400 may be completed within the master controller 302. Specifically, method 400 may be included in one or more programs, protocols, or instructions loaded into the memory of the master controller 302 and executed on the processor or one or more processors of the master controller 302. The method 400 may also be implemented in any of the systems described herein, such as the systems illustrated in FIGS. 1A through 2B. The order in which the operations are described is not intended to be construed as a limitation, and any number of the described blocks may be combined in any order and/or in parallel to implement the methods.

Turning to FIG. 4A, at block 402, the master controller 302 may determine whether a thermal cycle device is in operation. The master controller 302 may make such determinations based on a number of factors, including, but not limited to, determining whether electrical power is being generated, whether flow is occurring in the loop of the closed-loop thermal cycle device, and/or based on other factors (e.g., valve positions, pump speed, etc.).

At block 404, the master controller 302 may transmit a signal to cause heat carrier to be injected into the closed-loop thermal cycle device and/or intermediate heat exchangers. Initially, the amount of heat carrier may be preset, but may be adjusted based on a number of factors. Further, the type of heat carrier may be determined and updated based on the type of refrigerant or working fluid used in the closed-loop thermal cycle device.

At block 406, the master controller 302 may determine one or more characteristics or current characteristics of the closed-loop thermal cycle device and/or intermediate heat exchanger. The master controller 302 may determine such information based on feedback from one or more sensors at varying locations in or on the closed-loop thermal cycle device and/or the intermediate heat exchangers. Such characteristics may include temperature, pressure, flow rate, status of equipment, and/or equipment wear, among other characteristics.

At block 408, the master controller 302 may determine whether the temperature of the closed-loop thermal cycle device is within an operating range. For example, whether the temperature within the closed-loop thermal cycle device is too low such that electrical power may not be generated or may not be generated efficiently. The range or window may be defined by a minimum temperature at which the closed-loop thermal cycle device generates electricity.

At block 410, if the temperature is less than the operating range, the master controller 302 may determine whether heat carrier is mixed with the expander lubricant. The master controller 302 may determine such a characteristic based on data retrieved from a sensor or other meter within and/or corresponding to the expander. Such data or information may include an amount of heat carrier therein, expander wear, and/or other characteristics.

At block 412, the master controller 302 may divert the expander lubricant and heat carrier mixture to a separator (e.g., via a valve and a signal indicating open position adjustment sent by the master controller 302). At block 414, the master controller 302 may separate (e.g., by initiating a separator) the heat carrier from the expander lubricant. At block 416, the master controller 302 may return the expander lubricant to the expander and/or the heat carrier to the closed-loop thermal cycle device. The heat carrier may, in another embodiment, be transferred to a heat carrier storage area or tank. At block 418, the master controller 302 may determine if power is being generated. If not, the master controller 302 may determine whether closed-loop thermal cycle device operation is occurring. Otherwise, the master controller 302 may determine the characteristics of the closed-loop thermal cycle device again.

At block 420, the master controller 302 may determine whether measured characteristics are within an operating range. If the measured characteristics are no within an operating range, the master controller 302 may divert a working fluid and heat carrier mixture to a separator. At block 424, the master controller 302 may separate an amount of the heat carrier from the working fluid and heat carrier mixture. At block 426, the master controller 302 may return the working fluid to the closed-loop thermal cycle device.

This application claims priority to and the benefit of U.S. Provisional Application No. 63/478,012, filed Dec. 30, 2022, titled "SYSTEMS AND METHODS TO UTILIZE HEAT CARRIERS IN CONVERSION OF THERMALENERGY," the disclosure of which is incorporated herein by reference in its entirety.

In the drawings and specification, several embodiments of systems and methods to provide electrical power from heat of a flow of gas and/or other source have been disclosed, and although specific terms are employed, the terms are used in a descriptive sense only and not for purposes of limitation. Embodiments of systems and methods have been described in considerable detail with specific reference to the illustrated embodiments. However, it will be apparent that various modifications and changes can be made within the spirit and scope of the embodiments of systems and methods as described in the foregoing specification, and such modifications and changes are to be considered equivalents and part of this disclosure.

That claimed is:

1. A system for converting thermal energy to electrical power, the system comprising:

a closed-loop thermal cycle device including:

an evaporator including a first fluid path to accept and output a flow of heated fluid and a second fluid path to accept and output a flow of a working fluid and configured to indirectly transfer heat from the flow of heated fluid to the flow of the working fluid to cause the working fluid to change phases from a liquid to a vapor, an expander to generate electrical power via rotation by vapor state working fluid, a condenser to cool the flow of the working fluid to cause the working fluid to condense to the liquid, a pump to transport the liquid state working fluid from the condenser for heating, a loop for the flow of the working fluid defined by a successive fluid path through the evaporator, the expander, the condenser, and the pump, and an injection point positioned between the pump and the evaporator; and an amount of heat carrier injected into the loop via the injection point such that the amount of heat carrier flows in the successive fluid path and configured to adsorb and desorb the working fluid and, upon desorption and adsorption respectively, generate additional heat to increase output of electrical power.

2. The system of claim 1, wherein the heated fluid comprises one or more of a compressed gas at a pumping station, a wellhead fluid at a wellsite, a drilling fluid at a wellsite, or fluid from an engine's water jacket.

3. The system of claim 1, wherein one or more sensors are positioned along the loop to prevent clumping or mounding of the amount of heat carrier about the one or more sensors.

4. The system of claim 3, wherein the one or more sensors are positioned at one or more of an input of the second fluid path of the evaporator, an output of the second fluid path of the evaporator, an input of the condenser, an output of the condenser, within the pump, within the expander, or within portions of the loop.

5. The system of claim 4, wherein the one or more sensors comprise one or more of temperature sensors, pressure sensors, pressure transducers, or flow meters.

6. The system of claim 1, wherein the closed-loop thermal cycle device further (a) includes an extraction point and a valve positioned at the extraction point and (b) is configured to control the heat carrier and the working fluid to flowing from the loop.

7. The system of claim 6, further comprising a separator connected to the valve positioned at the extraction point and configured to separate the heat carrier from the working fluid.

8. The system of claim 7, wherein separated working fluid is transported back to the loop and wherein separated heat carrier is transported to a heat carrier storage area comprising a tank.

9. The system of claim 6, wherein the valve positioned at the extraction point is configured to, in response to a determination that a pressure detected by one or more sensors exceeds a selected pressure threshold indicating a potential blockage or clog, adjust to an open position to cause heat carrier and working fluid to flow therethrough.

10. The system of claim 1, wherein the injection point is configured to, in response to a determination that a temperature detected by one or more sensors is less than or equal to a selected temperature threshold indicating a temperature less than sufficient to cause the flow of working fluid to change phases from liquid to gas, increase an amount of heat carrier injected into the loop.

11. The system of claim 6, wherein the valve positioned at the extraction point is configured to, in response to a determination that a flow rate detected by one or more sensors is less than a selected flow rate threshold indicating a potential blockage or clog, adjust to an open position to cause heat carrier and working fluid to flow therethrough.

12. The system of claim 7, wherein the separator comprises one or more of a centrifuge or a filter.

13. The system of claim 1, wherein the heat carrier comprises metal organic framework or metal organic heat carrier.

14. The system of claim 1, wherein the heat carrier adsorbs working fluid within the pump thereby increasing heat within the pump to substitute as a portion of external work output.

15. The system of claim 1, wherein the heat carrier desorbs working fluid in the evaporator thereby causing desorbed working fluid to extract additional heat from the heated fluid.

16. The system of claim 1, wherein the heat carrier adsorbs working fluid within the expander thereby increasing heat in the expander and increasing work output of the expander.

17. The system of claim 1, wherein the pump is configured to exhibit lower sensitivity to cavitation and wherein seals corresponding to the pump are configured to withstand damage caused by the heat carrier.

18. The system of claim 1, wherein each particle of the amount of heat carrier is about 1 micron to 10 micron.

19. The system of claim 18, wherein the heat carrier is selected to prevent damage to the expander based on tolerances therein.

20. The system of claim 1, wherein internal geometries of the evaporator and loop are configured to prevent one or more of clumping, buildup, or erosion therein.

21. The system of claim 1, wherein a selected oil lubricates the expander.

22. The system of claim 21, wherein the selected oil attracts a portion of the amount of heat carrier.

23. The system of claim 22, wherein the selected oil and the portion of the amount of heat carrier is transported to a centrifuge or filter, wherein the centrifuge or filter separates the selected oil from the heat carrier, and wherein the selected oil is transported to the expander and separated heat carrier is injected into the loop via the injection point.

24. The system of claim 1, wherein the closed-loop thermal cycle device comprises an organic Rankine cycle device, a Rankine cycle device, a Kalima cycle device, Goswami cycle device, Bell Coleman cycle device, Carnot cycle device, Ericsson cycle device, Hygroscopic cycle device, Scuderi cycle device, Stirling cycle device, Manson cycle device, or Stoddard cycle device.

25. A non-transitory computer-readable medium with instructions stored thereon, that when executed with a processor performs steps to control a conversion of thermal energy to electrical power via a closed-loop thermal cycle device injected with an amount of heat carrier, comprising:

a first set of one or more inputs in signal communication with a corresponding one or more temperature sensors positioned along a loop of the closed-loop thermal cycle device and to provide a temperature of working fluid at a position of the loop; and a first input/output, each of the inputs/outputs in signal communication with a heat carrier injection valve, the non-transitory computer-readable medium configured to:

during a closed-loop thermal cycle device operation:

in response to any temperature of the working fluid at any position of the loop being less than sufficient to cause a flow of working fluid to change phases from liquid to gas, transmit a signal to cause the heat carrier injection valve to inject an amount of heat carrier in the loop.

26. The non-transitory computer-readable medium of claim 25, wherein an additional amount of heat carrier is injected into the loop based on periodically measured temperatures of the working fluid.

27. The system of claim 1, wherein the closed-loop thermal cycle device further includes a valve positioned at the injection point, the valve configured to a) inject a predetermined amount of heat carrier and b) in response to a determination that is less than a selected temperature threshold, adjust to an open position to cause heat carrier to flow therethrough.

28. The system of claim 6, wherein the extraction point is positioned within the expander and configured to withdraw an expander lubricant comprising the working fluid and an excess of a threshold of the heat carrier therein.

* * * * *